US008910313B2

(12) United States Patent
Gordon et al.

(10) Patent No.: US 8,910,313 B2
(45) Date of Patent: Dec. 16, 2014

(54) APPAREL

(75) Inventors: Josh Robert Gordon, Portland, OR (US); Brady Campbell Anderson, Portland, OR (US); Bobbie John Monahan, Herzogenaurach (DE); Trudy Anne Watson, Portland, OR (US); Martina Stattelmann, Meggen (CH)

(73) Assignee: adidas AG, Herzogenaurach (DE)

( * ) Notice: Subject to any disclaimer, the term of this patent is extended or adjusted under 35 U.S.C. 154(b) by 1091 days.

(21) Appl. No.: 12/926,051

(22) Filed: Oct. 22, 2010

(65) Prior Publication Data

US 2011/0099680 A1 May 5, 2011

(30) Foreign Application Priority Data

Oct. 22, 2009 (DE) ..... 10 2009 045 931

(51) Int. Cl.
*A41D 13/00* (2006.01)
*A41D 27/28* (2006.01)

(52) U.S. Cl.
CPC ..... *A41D 27/28* (2013.01); *A41D 2400/22* (2013.01); *A41D 2400/60* (2013.01)
USPC ..... 2/69

(58) Field of Classification Search
USPC ..... 2/69, 79, 227, 82, 108, 115, 181, 244
See application file for complete search history.

(56) References Cited

U.S. PATENT DOCUMENTS

| | | | | |
|---|---|---|---|---|
| 2,391,535 | A * | 12/1945 | Zelano | 2/93 |
| 2,715,226 | A * | 8/1955 | Weiner | 2/79 |
| 3,045,243 | A * | 7/1962 | Lash et al. | 2/1 |
| 4,722,099 | A | 2/1988 | Kratz | |
| 5,636,380 | A | 6/1997 | Schindler et al. | |
| 6,286,151 | B1 | 9/2001 | Lambertz | |
| 6,332,221 | B1 | 12/2001 | Gracey | |
| 6,427,242 | B1 | 8/2002 | Bush et al. | |
| 6,918,140 | B1 * | 7/2005 | Cooper | 2/228 |
| 7,395,557 | B1 * | 7/2008 | Ledyard | 2/113 |
| 7,428,772 | B2 | 9/2008 | Rock | |
| 7,437,774 | B2 * | 10/2008 | Baron et al. | 2/69 |
| 7,934,267 | B2 * | 5/2011 | Nordstrom et al. | 2/69 |
| 2005/0086721 | A1 | 4/2005 | Lambertz | |
| 2006/0179539 | A1 | 8/2006 | Harber | |
| 2009/0031486 | A1 | 2/2009 | Sokolowski et al. | |

FOREIGN PATENT DOCUMENTS

| | | |
|---|---|---|
| DE | 20 2008 001 340 | 4/2008 |
| WO | WO 03/065833 | 8/2003 |

* cited by examiner

*Primary Examiner* — Tejash Patel
(74) *Attorney, Agent, or Firm* — Sterne, Kessler, Goldstein & Fox P.L.L.C.

(57) ABSTRACT

An aspect of the invention relates to a garment which comprises at least a first zone and a second zone. The first zone of the garment is arranged in the spine area and comprises a higher degree of air permeability than the second zone. The second zone of the garment is arranged below the breast area and in the area of the lumbar vertebrae and comprises a higher degree of moisture wicking than the first zone.

56 Claims, 16 Drawing Sheets

APPAREL

BACKGROUND OF THE INVENTION

1. Field of the Invention

The present invention relates to apparel, in particular to sportswear.

2. Background Art

Apparel often has to comply with different requirements. On the one hand, apparel has to protect the body from exterior influences such as heat, cold and wind. On the other hand, it may be necessary to support the thermal regulation of the body itself, for example, to facilitate evaporation of sweat on the skin and to avoid undesired production of sweat on the skin. Thermal regulation is understood to be the active balancing of exterior climate conditions and inner influences by a garment which provides a comfortable feeling for the wearer of the garment. This combined effect of exterior as well as interior influences puts high demands on the design of apparel and the materials used therefore. This applies in particular to sportswear.

In order to solve these problems, U.S. Pat. No. 6,332,221 suggests reduced insulation and/or increased ventilation in temperature sensitive areas of the body. Temperature sensitive areas are considered to be the spine, areas without fatty tissue and without muscles and areas with increased production of sweat. Similarly, U.S. Pat. No. 4,722,099 describes patches of a motorcycle suit with increased ventilation.

U.S. Pat. No. 6,286,151 describes a heat-regulating sock in which an air channel is made from a heat-regulating netted fabric which conducts sweat out of the shoe.

WO 03/065833 A1 and US 2005/0086721 describe a thermo regulating item of clothing with a thermo regulating area. A fabric guides humidity away from the skin towards the textile surface by means of capillary action.

From the US 2006/0179539 it is known to determine the size and location of ventilation openings and heat insulation areas based on a thermal profile of a body.

Further, U.S. Pat. No. 5,636,380 describes thermoregulatory apparel with insulating panels made from a fabric having moisture wicking capability. In US 2009/0031486 garment for cold weather with zones of increased thermal insulation is described. The zones are arranged in a gender-specific way. U.S. Pat. No. 7,428,772 discloses apparel with areas of different heat insulation.

The German utility model DE 20 2008 001 340 U1 describes an upper garment which has an increased air permeability in the underarm/armpit area.

The prior art therefore teaches different approaches which cover isolated aspects of thermal regulatory apparel such as the combination of heat insulation and ventilation in the U.S. Pat. No. 6,332,221 or solutions for particular applications such as motorcycle suits in the U.S. Pat. No. 4,722,099. However, these approaches lack a systematic basis from which the selection of materials for thermal regulation and the arrangement of areas of the garments in which these materials shall be used can be determined.

Embodiments of the present invention are therefore based on the unmet need to provide garments which provide an improved thermal regulation on a systematic basis. A further unmet need is to maintain the body temperature during an activity at cold or warm outdoor temperatures at approximately 37 degrees Celsius. This supports not only the wellness but also the performance of the wearer of the garment since muscles, nerves, heart and breathing are positively supported.

BRIEF SUMMARY OF THE INVENTION

To solve this problem, applicant initially has performed extensive empirical investigations of the thermal behavior of the human body during different sports activities. To this end, sweat was "collected" and measured at different locations of the body of women and men during sports activities. The essential parameters of the thermal behavior selected for this investigation are temperature, wind pressure and sweat production on the surface of the body. The results of these measurements are, for example, illustrated in the body maps of skin temperature in FIGS. 1*a* and 1*b*, wind pressure in FIG. 1*c* and sweat production in FIGS. 2*a* and 2*b*. These measurements enable far-reaching conclusions for requirements on the design of thermoregulatory apparel. These requirements of garments are represented with defined climate zones which are illustrated, for example, in FIGS. 3 to 6, 9 and 12 and which are embodied in one or more of the following aspects of the invention. For example, specific areas of the body are particularly warm but emit little sweat which could contribute to a cooling of the body. This results in the requirement of additional heat conduction away from these areas. A further result of these investigations is that there are gender-specific differences between the thermal behavior of the male and the female body. Further, the requirements of thermal regulatory apparel have seasonal-specific differences (winter, summer).

Embodiments of the invention relate to a garment which comprises at least a first and a second zone. The first zone of the garment is arranged in the spine area and comprises a higher degree of air permeability than the second zone. The second zone of the garment is arranged below the breast and in the area of the lumbar vertebrae, wherein the second zone comprises a higher degree of moisture wicking than the first zone. The area of the lumbar vertebrae may extend over the whole width of the back and may comprise the area of the kidneys.

This embodiment of the invention may fulfill the requirements for a summer garment both for women and for men. From the maps of sweat production (FIGS. 2 and 2*b*) it can be recognized that women and men sweat in particular in the spine area and that the skin temperature according to the maps of skin temperature is particularly high in this region (FIGS. 1*a* and 1*b*). This heat can be used to evaporate the additional sweat in that the air permeability of the garment in the first zone is higher than in the second zone of the garment, i.e. below the breast and in the area of the lumbar vertebrae. This causes an increased evaporation of sweat in the first zone. From the maps of skin temperature (FIGS. 1*a* and 1*b*) it can be further recognized that the second zone is rather cool while much sweat is emitted (FIGS. 2*a* and 2*b*). Similar to the first zone it is therefore necessary to remove additional sweat. However, in contrast with the first zone, it is not possible to achieve this by increased ventilation since there is not sufficient heat to completely evaporate the additional sweat, due to the lower skin temperature. This causes the so-called "pooling": sweat accumulates and causes an unpleasant wet sensation. Further, this sweat cannot be used for cooling because it does not evaporate.

This problem is solved in that the second zone comprises a higher degree of moisture wicking than the first zone. The increased moisture wicking of the material of the second zone facilitates the transport of sweat from the inside of the material, i.e. the side directed to the skin, to the outside of the material where the sweat can evaporate. A higher degree of air permeability or ventilation in this second zone (as in the first zone) without removal of the sweat would lead to an accumulation of sweat and to an unpleasant wet sensation. Therefore, only the combination of the two zones and their particular arrangement according to this embodiment of the invention enables a garment with a significantly improved thermal regulation.

In an embodiment of the present invention, the first area with higher degree of air permeability extends in addition in the shoulder area. Such a garment is particularly suitable for men who have a high skin temperature on the shoulders (e.g., FIGS. 1 and 1*b*) and have a high sweat production in this area (e.g., FIGS. 2*a* and 2*b*).

A further aspect of the present invention relates to a garment which comprises at least a first, a second and a third zone. The first zone of the garment comprises a higher degree of air permeability than the other zones. The second zone of the garment comprises a higher degree of moisture wicking than the other zones. The third zone of the garment comprises a higher degree of wind protection than the other zones. The third zone is preferably arranged on the front sides of the arms and on the front side of the torso and/or on the front sides of the thighs.

This embodiment of the invention may fulfill the requirements of a garment both for men and for women and for each season. As in the preceding first aspect, the garment comprises a first zone with a higher degree of air permeability and a second zone with a higher degree of moisture wicking than the other zones. However, there are areas on the front side of the body which are subject to a high wind pressure (see, e.g., FIG. 1*c*) and which have a lower skin temperature and a lower sweat production than the other zones. In contrast with the first and the second zone, these areas have to be protected from over cooling, wherein no additional ventilation is desirable due to the lower sweat production. The problem of an improved thermal regulation of the third zone can therefore be solved by a higher degree of wind protection than in the first and the second zone. A garment according to this embodiment may be advantageous in situations in which cool air or wind may cause an over cooling of the mentioned areas of the body, for example during running on a cool morning or when wind blows.

In another embodiment of the present invention, in addition to a first and a second zone or a first, a second, and a third zone, a garment may further include a fourth zone which has a lower thermal resistance than the other zones. This embodiment concerns preferably a garment for the summer. As can be derived from the maps for skin temperature (FIGS. 1*a, b*) and sweat production (FIGS. 2*a*, 2*b*), there are zones of the body with a high skin temperature and low sweat production. These areas are not sufficiently cooled by evaporation of sweat and therefore require additional cooling. This problem is solved by the fourth zone which comprises a lower thermal resistance than the other zones, by using, for example a material with a lower thermal resistance, i.e. increased heat conductivity, or a very thin material or a combination of very thin and of heat conducting materials. This causes conduction of heat from the inside of the garment to the outside where it can be emitted to the atmosphere, so that an additional cooling is achieved.

Another embodiment of the present invention relates to a garment which comprises at least a first, a second and a fourth zone, respectively comprising a higher degree of air permeability and moisture wicking and a lower degree of thermal resistance than the other zones. In contrast with the garment according to the preceding embodiment of the present invention which includes wind protection, this embodiment of the invention comprises the conduction of heat by a material with a lower thermal resistance in those areas of the body which have a high skin temperature but low sweat production. Such a garment may therefore be advantageous in situations which require a comprehensive cooling of the body, for example during warm weather. In a preferred embodiment for men the fourth zone is arranged laterally at the torso and in the elbow area. In a preferred embodiment for women the fourth zone is arranged in the shoulder area and in the elbow area and/or on the front sides and the back sides of the lower legs.

Another embodiment of the present invention relates to a garment which comprises at least a first, a second and a fifth zone which respectively comprise a higher degree of air permeability, moisture wicking and heat insulation than the other zones. This embodiment concerns a garment for activities during low outdoor temperatures which require a careful balancing between over cooling and overheating of the body. This aspect of the invention is based on the insight that such a balance cannot be achieved uniformly for the whole garment, but only by a combination of differently located zones which respectively comprise a higher air permeability, moisture wicking and heat insulation than the other zones. As already described above, there are areas of the body which require a higher degree of air permeability (high skin temperature and high sweat production) and increased moisture wicking (low skin temperature and high sweat production). In addition, areas of the body with low skin temperature and low sweat production need increased heat insulation, as can be recognized in the corresponding maps for skin temperature (FIGS. 1*a, b*) and sweat production (FIGS. 2*a*, 2*b*). Typically these are areas with embedded fat, in order to protect the body. An improved thermal regulation therefore may require in addition a fifth zone which comprises an increased insulation, according to this aspect of the invention.

In another embodiment the garment according to this aspect of the invention comprises a first layer and a second layer. A particular zone may be arranged both in the first layer and in the second layer. For example, the first zone can be arranged both in the first layer laterally at the torso and in the second layer laterally at the torso, in the shoulder area, and in the spine area.

In embodiments of the present invention, the first to fifth zones may overlap, or one zone may completely include another zone. Overlapping areas can be realized, for example, by materials which fulfill the requirements of several zones. For example, a material with increased wind protection may also have increased heat insulation. Alternatively, overlapping zones can be realized by a multi-layer material, wherein one layer fulfills the requirements of one zone and a further layer fulfills the requirements of another zone.

Embodiments of these four aspects of the invention comprise advantageous arrangements of one or more of the first to fifth zones which are based on the requirements to thermo regulated apparel which are illustrated in FIGS. 3 to 6 and which are designated in the following also as climate zones.

In an embodiment, a garment may further include a sixth zone having at least one entry vent. This enables to introduce air into the garment which provides an additional removal of heat and wetness. This improves the evaporation of sweat and therefore causes cooling of the body. Preferably, the at least one vent is arranged between the shoulder area and the breast area and/or laterally at the torso, since in these locations the air circulates best around the body. The air which enters the garment may not only hit a surface but can circulate along the shoulder respectively and along the torso. This supports the supply of air to the first zone which requires a higher degree of air permeability. Preferably, the at least one entry vent can be partially closed.

In one embodiment, the first zone of the garment comprises a material which has an air permeability which is at least about 15% higher in a wet state than in a dry state. In one embodiment, the first zone comprises a material with a yarn whose length changes when being exposed to moisture. This enables to modify the air permeability of the material so that it increases when exposed to moisture due to sweat production, in order to evaporate sweat.

In one embodiment, the second zone comprises a material which transports moisture due to its capillary action. In this way, thermal regulation of areas with high sweat production and low skin temperature can be effectively achieved. The capillary action can be affected by the material construction and/or yarn properties of the material of the second zone. The capillary action can also be affected by a chemical treatment of the material of the second zone.

In one embodiment, the third zone comprises a material with high density, a laminated material, a coated material including a material with a liquid coating, and/or material layers connected with glue points. This increases the degree of wind protection of the third zone.

In one embodiment, the fourth zone comprises a material having a thermal resistance which is less than about 6·103 m2K/W. The resulting conduction of heat away from areas with high skin temperature and low sweat production leads to a cooling of these areas.

In one embodiment, the fifth zone comprises a material with interspaces for enclosing air. This causes a higher degree of heat insulation. The interspaces for enclosing air of the fifth zone may be generated during manufacture of the material, by subsequent treatment of the material, or by filling of the material.

Further embodiments of the garment according to embodiments of the invention are defined in further dependent claims.

BRIEF DESCRIPTION OF THE DRAWINGS/FIGURES

In the following, aspects of the present invention are explained in more detail with reference to the accompanying drawings. These figures show:

FIG. 1*a* is a front view of an exemplary male and a female body with skin temperatures during sports activities according to an embodiment of the present invention;

FIG. 1*b* is a back view of an exemplary male and a female body with skin temperatures during sports activities according to an embodiment of the present invention;

FIG. 1*c* is a front view of an exemplary male and a female body with wind pressure according to an embodiment of the present invention;

FIG. 2*a* is a front view of an exemplary male and a female body with degree of sweat production during sports activities according to an embodiment of the present invention;

FIG. 2*b* is a back view of an exemplary male and a female body with degree of sweat production during sports activities according to an embodiment of the present invention;

Figure 16A:
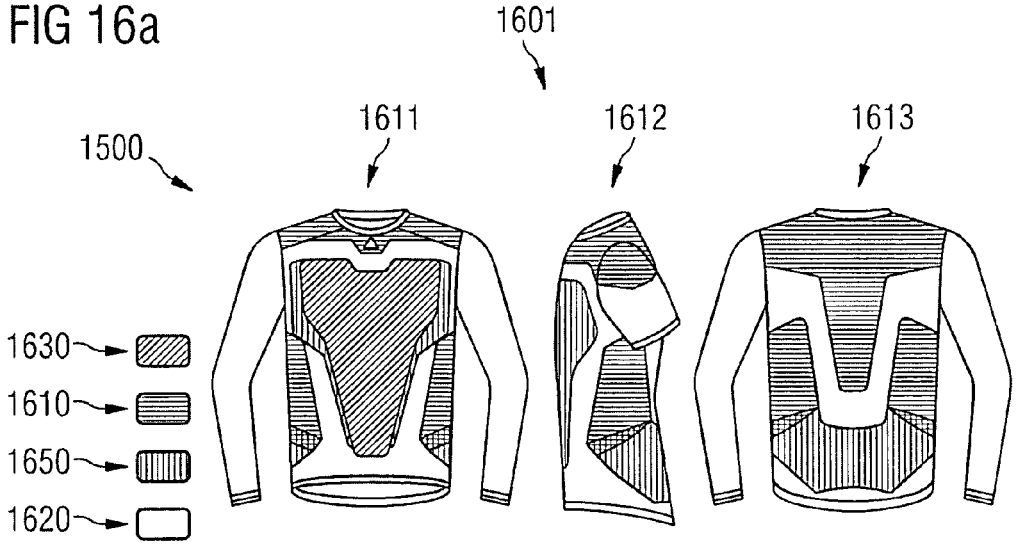
Figure 16B:
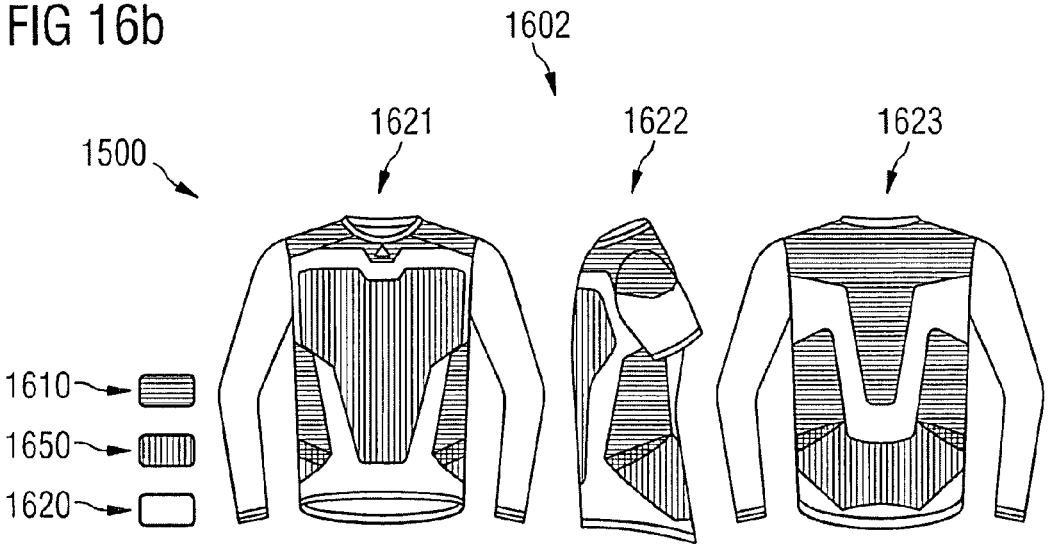
Figure 17:
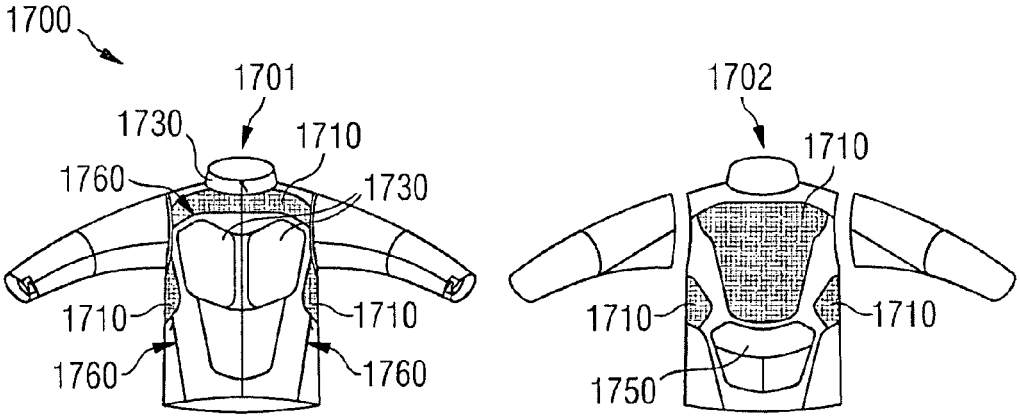
Figure 18:
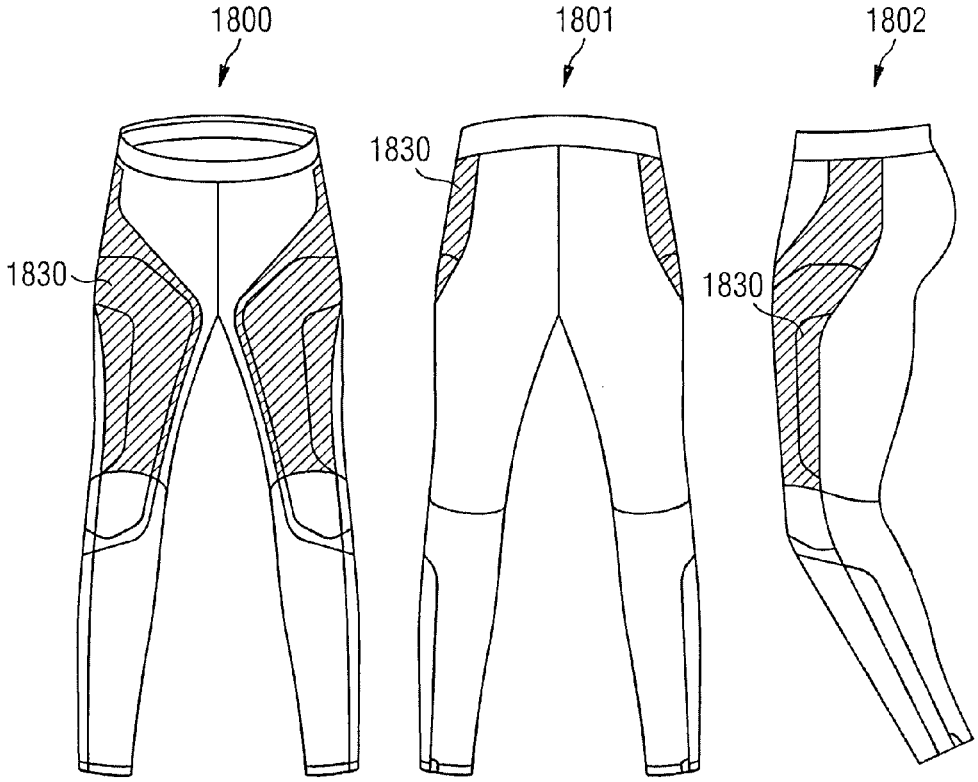
Figure 19:
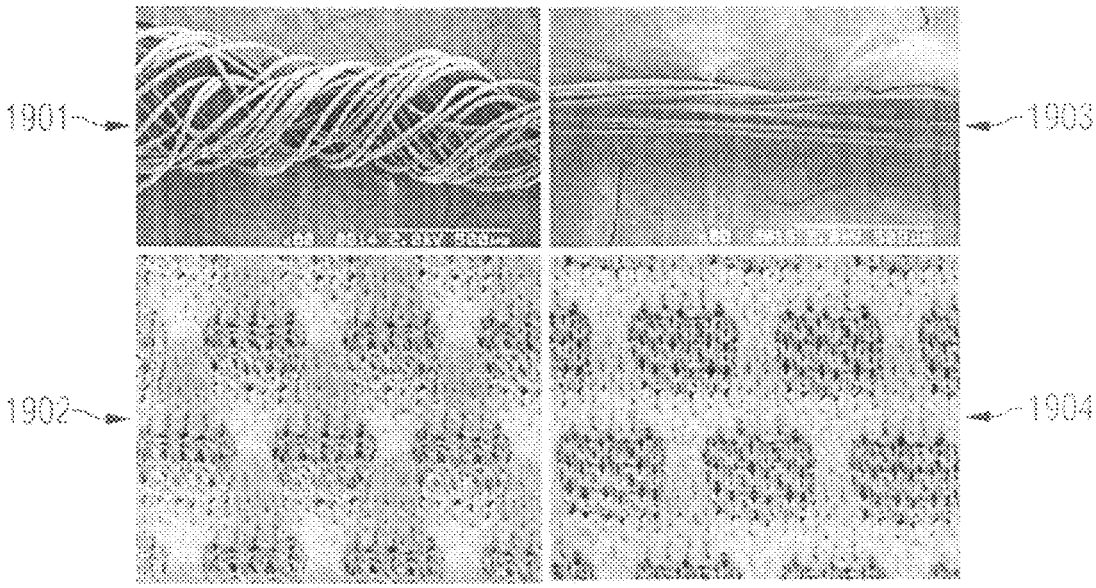
Figure 20:
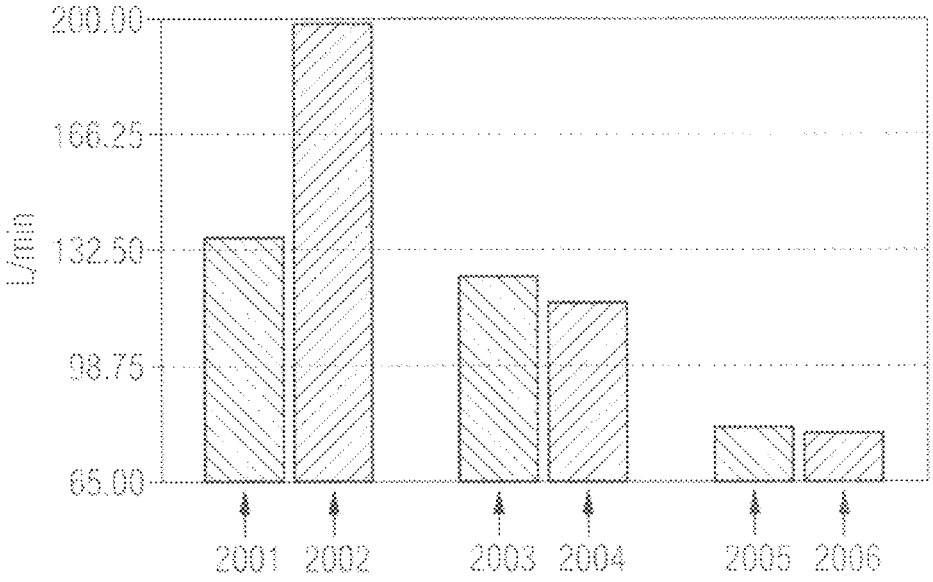
Figure 21:
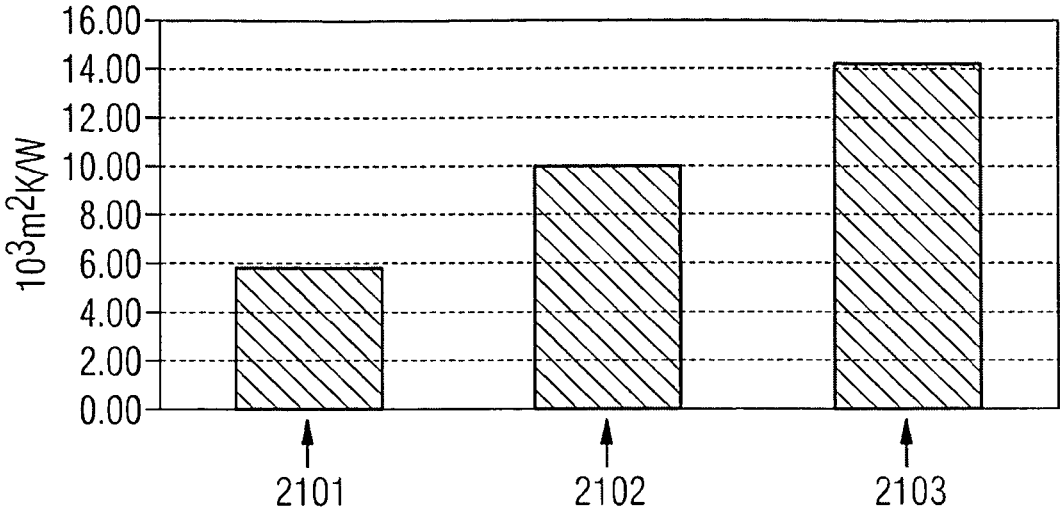
Figure 22:
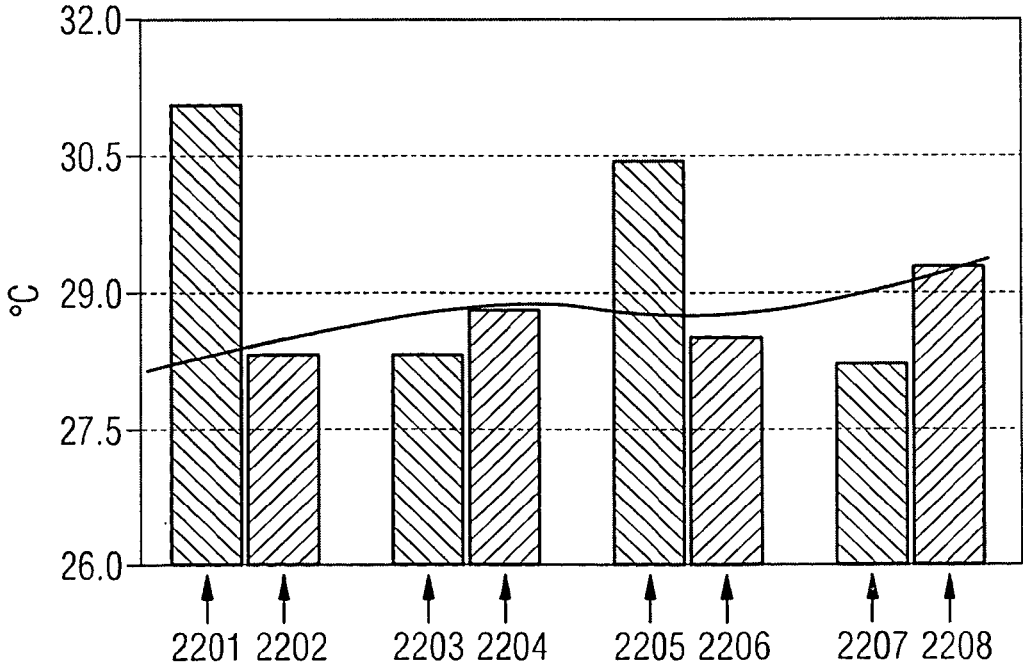
Figure 23:
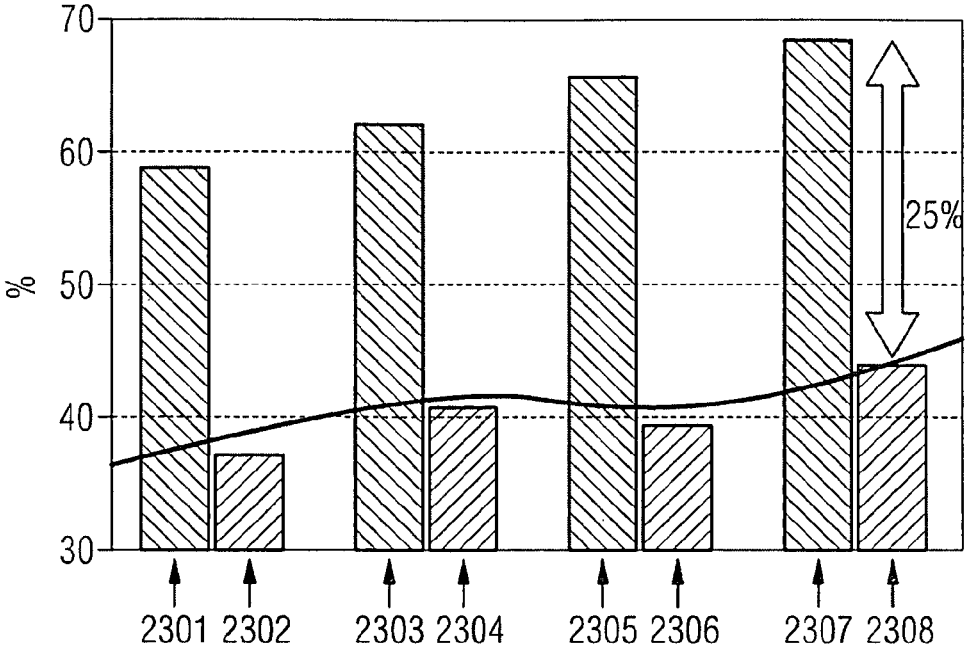
Figure 24:
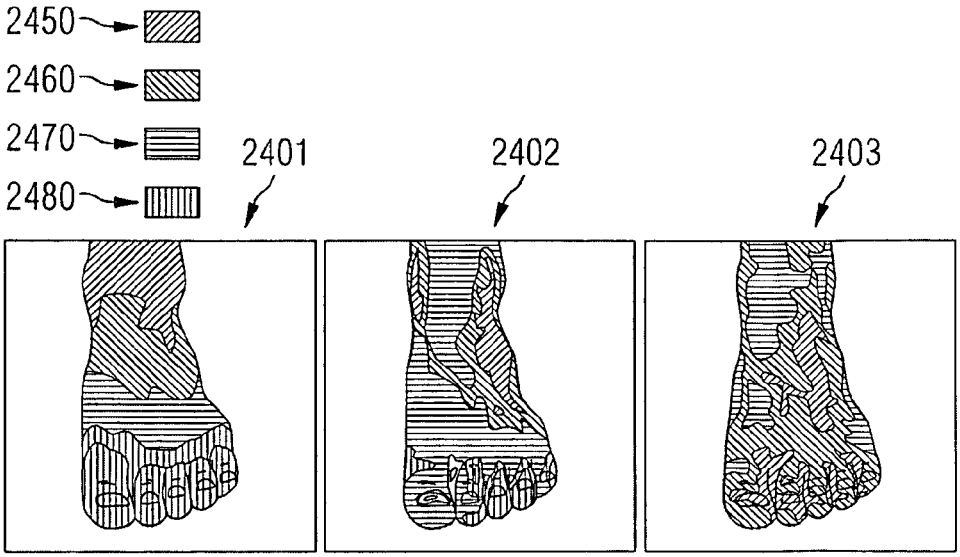
Figure 25:
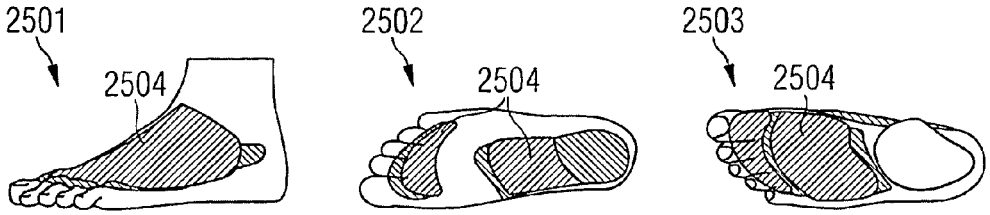
Figure 26:
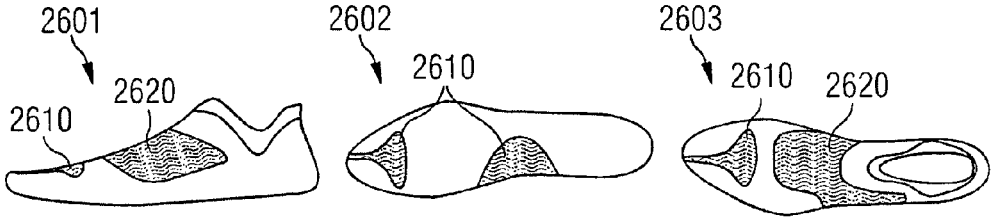
Figure 27:
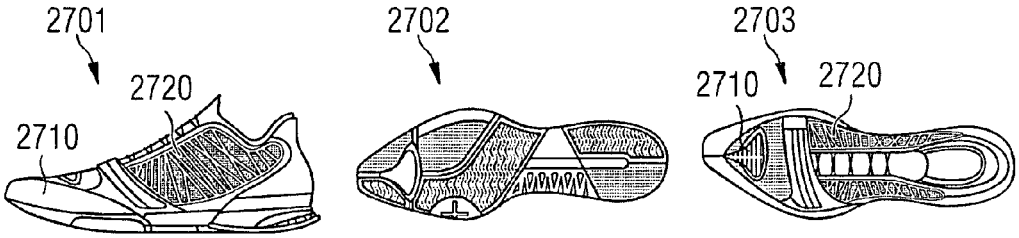
Figure 28:
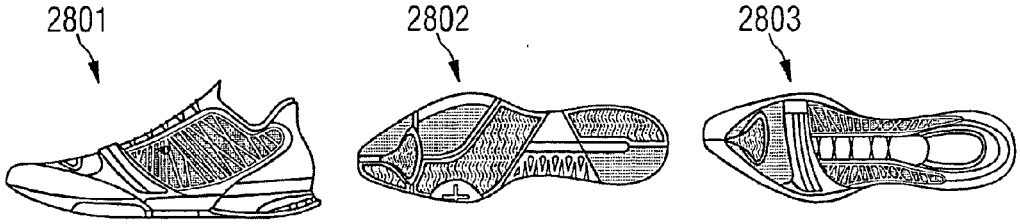

FIG. 16*a* is a front view, side view, and back view of a garment according to an embodiment of the present invention;

FIG. 16*b* is a front view, side view, and back view of a garment according to an embodiment of the present invention;

FIG. 17 is a front view and back view of a garment according to an embodiment of the present invention;

FIG. 18 is a front view, back view and lateral view of a garment according to an embodiment of the present invention;

FIG. 19 illustrates a material for the first climate zone of a garment with increased air permeability according to an embodiment of the present invention;

FIG. 20 is an exemplary graph of measurements of the air permeability of different materials according to an embodiment of the present invention;

FIG. 21 is an exemplary graph of measurements of the thermal resistance of different materials according to an embodiment of the present invention;

FIG. 22 is an exemplary graph of measurements of the skin temperature during different activities according to an embodiment of the present invention;

FIG. 23 is an exemplary graph of measurements of the relative skin humidity during different activities according to an embodiment of the present invention;

FIG. 24 illustrates perspective views of a foot with skin temperatures according to an embodiment of the present invention;

FIG. 25 illustrates areas of sweat production of a foot according to an embodiment of the present invention;

FIG. 26 is a side view, bottom view, and a top view of a sock with first and second zones according to an embodiment of the present invention;

FIG. 27 is a side view, bottom view, and a top view of a shoe with first and second zones according to an embodiment of the present invention; and FIG. 28 is a side view, bottom view, and a top view of a combined system of a sock and shoe with first and second zones according to an embodiment of the present invention.

DETAILED DESCRIPTION OF THE INVENTION

The present invention will now be described in detail with reference to embodiments thereof as illustrated in the accompanying figures. While specific configurations and arrangements are discussed, it should be understood that this is done for illustrative purposes only. References to "an embodiment", "one embodiment", "another embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the spirit and scope of the invention to affect such feature, structure, or characteristic in connection with other embodiments whether or not explicitly described.

In the following, embodiments and modifications of the present invention are explained in more detail with respect to sports garments. In addition, embodiments of the invention can be applied to all kinds of garments which require an improved thermal regulation during special climate conditions, during physical activity or in any other application.

Figure 1A:
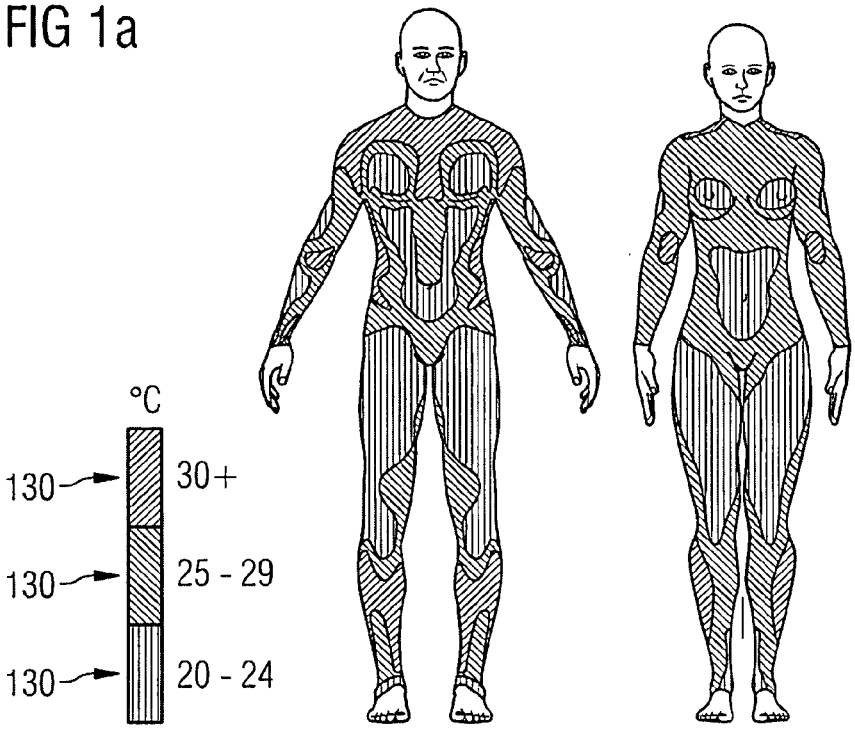
Figure 1B:
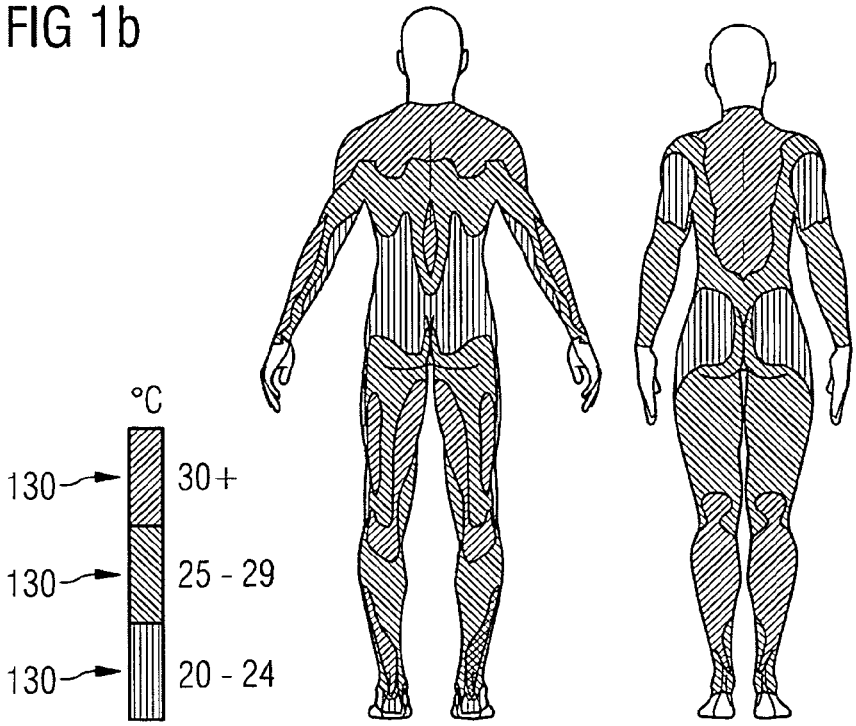

FIG. 1*a* shows front views and FIG. 1*b* shows back views of a male and a female body, on which skin temperatures during sports activities are represented. These views show areas of high temperature 130 with temperatures above about 30 degrees, areas with medium skin temperature 125 with temperatures of about 25-29 degrees and areas with low skin temperature 120 with temperatures of about 20-24 degrees.

As can be further recognized in FIGS. 1*a* and 1*b*, the area of high skin temperature 130 of the male body is essentially located in one or more of the shoulder area, in the spine area, in the area of the breast bone, laterally at the torso, at the lower arms, on the back sides of the thighs and the knees, and at the lower legs. The area of medium skin temperature 125 is essentially located in one or more of the area of the torso, on the arms and on the back sides of the legs. The area of low skin temperature is essentially located in one or more of the breast area, in the stomach area, in the lower part of the back, and on the front sides of the thighs.

FIGS. 1*a* and 1*b* further show that the area of high skin temperature 130 of the female body is essentially located in one or more of the back side of the body on the shoulders, in a broad area around the spine and on the back sides of the lower legs. The area of medium skin temperature 125 of the female body essentially extends in one or more of the torso, on the arms and on the back sides of the thighs. The area of low skin temperature 120 of the female body extends in one or more of the back sides of the upper arms, in the breast area and in the stomach area, on the buttocks and on the front sides of the thighs.

Figure 1C:
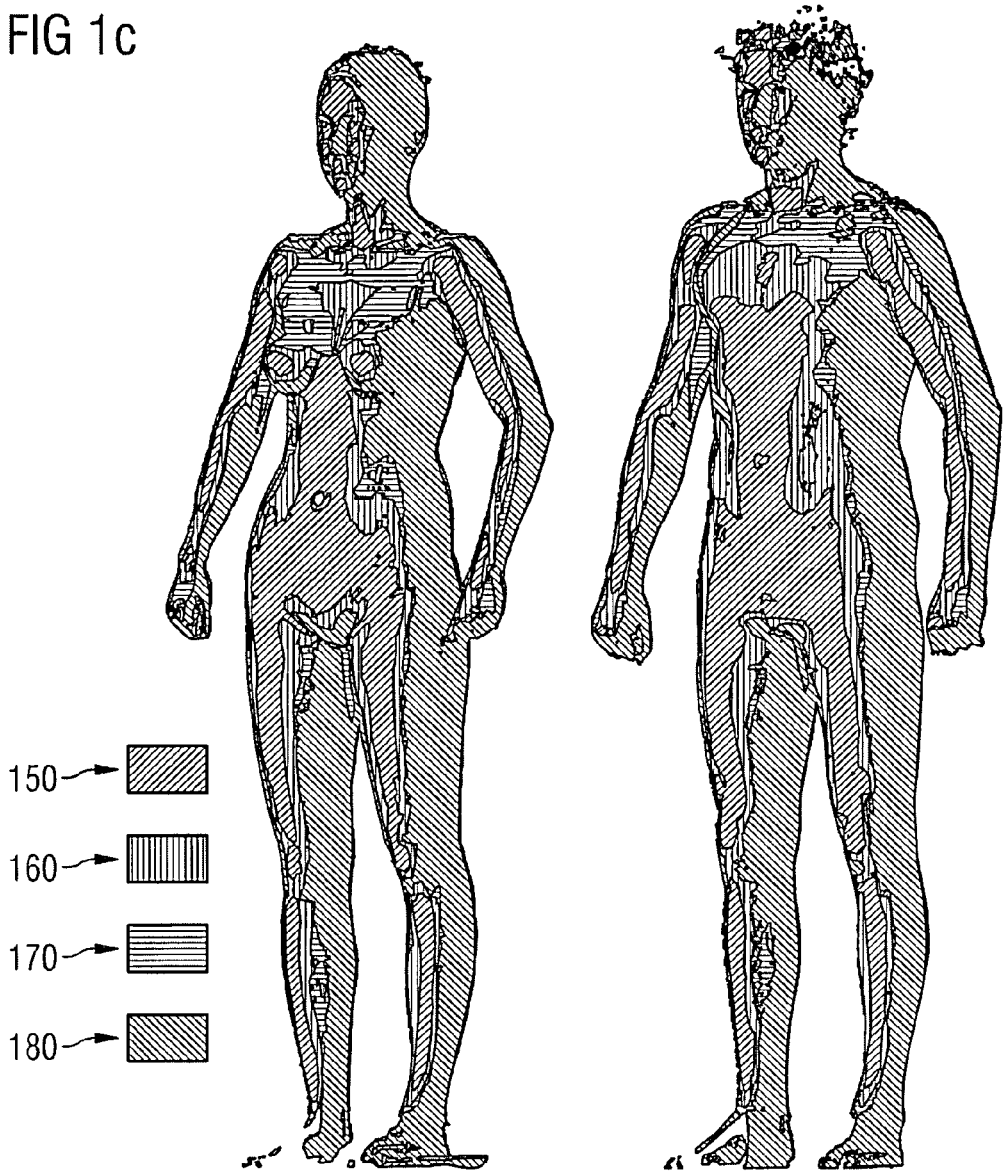

FIG. 1*c* shows front views of a male and a female body on which the wind pressure is illustrated, with areas of very high wind pressure 150, areas of high wind pressure 160, areas of medium wind pressure 170, and areas of low wind pressure 180. In order to determine these areas an air stream relative to the body surface was measured, wherein air streams which hit the body orthogonally have a higher air pressure (Pa) than air streams which hit the body at an oblique angle or in parallel.

Figure 2A:
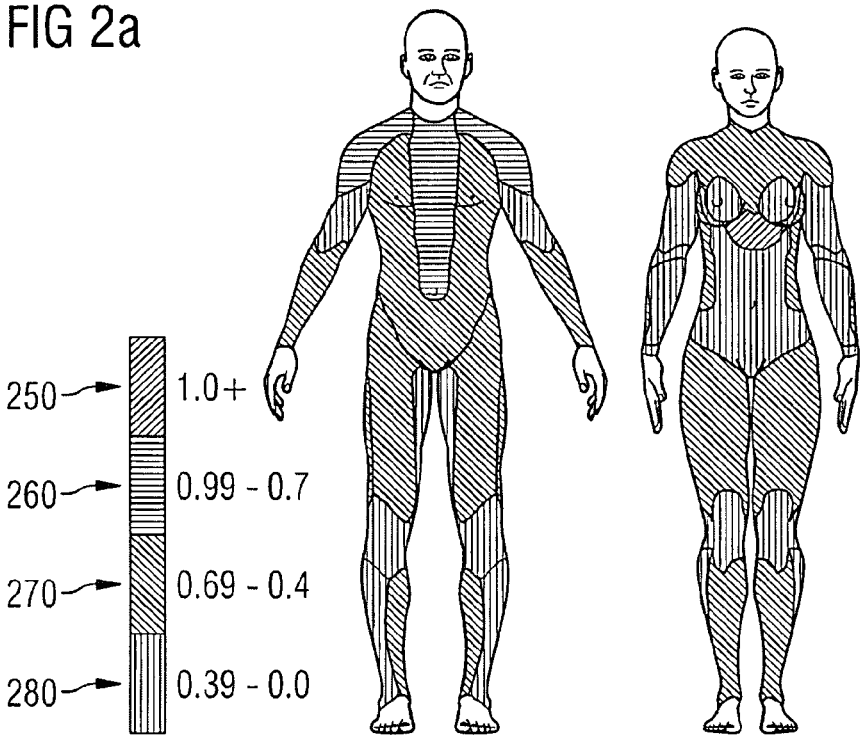
Figure 2B:
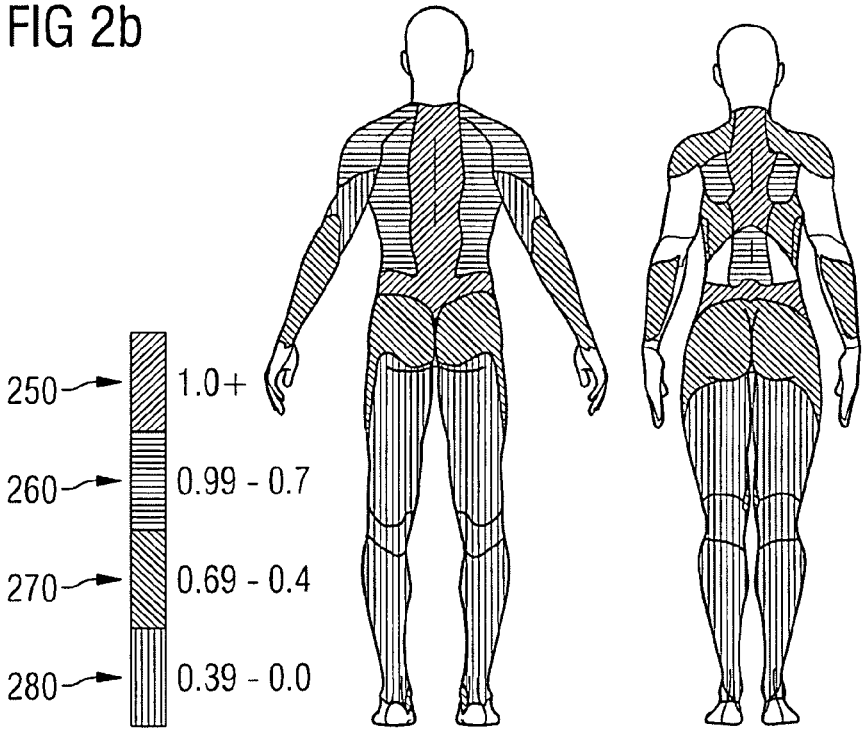

FIG. 2*a* shows front views and FIG. 2*b* shows back views of a male and a female body on which the degree of sweat production during sports activity is represented. Both figures show areas of very high sweat production 250 (greater than about 1.0), areas of high sweat production 260 (0.99-0.7), areas of medium sweat production 270 (0.69-0.4) and areas of low sweat production 280 (0.39-0.0). The indicated values of sweat production are relative values without units.

As further shown in FIGS. 2*a* and 2*b*, areas of very high sweat production 250 of the male body are essentially located in the spine area and above the hips on the back. Areas of high sweat production 260 are arranged essentially along the center line of the breast, on the shoulders and laterally on the back. Areas of low sweat production 280 are mainly located on the back sides of the legs. The female body has the areas of very high sweat production 250 essentially in the area of the spine, above the hips on the back and below the breast area. The area of medium sweat production 270 is arranged on the shoulders. Sweat production on the shoulders of women is lower than for men. Areas of low sweat production 280 of the female body are essentially located in the breast area and in the stomach area and on the back sides of the legs.

From the skin temperatures and the sweat production in FIGS. 1*a*, 1*b* and 2*a*, 2*b* requirements for different zones for thermal regulation of a garment can be derived, which are designated as climate zones in the following and which are illustrated, for example, in FIGS. 3-6, 9, and 12.

In one embodiment, a first climate zone concerns an area which has both a high skin temperature and strong sweat production. Such areas require both cooling and removal of sweat. This may be achieved by a higher degree of air permeability of the garment which evaporates the sweat together with the high skin temperature. Thereby sweat is removed from the skin, and the skin is cooled by the evaporative heat loss. To this end, the garment comprises increased air permeability along the first climate zone in one embodiment.

In one embodiment, a second climate zone of the garment with increased moisture wicking is arranged in areas of the body which is characterized by high production of sweat and by skin temperatures in the medium or low range so that evaporation is lower than in the first climate zone. In these areas, sweat may accumulate which does not evaporate so that the garment gets wet in this area. This problem may be solved by wicking the additional sweat to the outside of the garment where the sweat can evaporate, using a corresponding material of the garment. The second climate zone therefore comprises increased moisture wicking of the material of the garment in one embodiment.

In one embodiment, a third climate zone is arranged in areas of the body which are characterized by a low skin temperature and a low sweat production together with strong wind pressure (see, e.g., FIG. 1*c*). These areas which are subject to strong wind pressure are located on the front side of the body and have to be protected from over cooling. In particular, important organs have to be protected. This problem may be solved by wind proof materials so that the third climate zone comprises an increased wind protection of the material of the garment in one embodiment.

In one embodiment, a fourth climate zone is arranged in areas of the body which show a high skin temperature while having low sweat production. This area therefore requires additional cooling. This problem may be solved by heat conducting materials of the garment which conduct heat away from the skin surface to the outside of the garment and thereby cool the body. The fourth climate zone therefore comprises increased heat conductivity, i.e. a reduced thermal resistance, of the material of the garment in one embodiment.

In one embodiment, a fifth climate zone concerns areas of the body with low skin temperature and low sweat production which therefore require protection from over cooling. This is similar to the third climate zone which, however, only protects areas on the front side of the body being exposed to high wind pressure. The fifth climate zone mainly concerns areas in which the body accumulates fat in order to protect sensitive parts of the body and organs lying beneath the fat. Therefore, the fifth climate zone provides additional heat insulation, in particular at low temperatures, for example in autumn and winter in one embodiment.

In one embodiment, a sixth climate zone finally comprises vents arranged at the garment which are preferably applied in a multi-layer garment to provide supply of fresh air. This causes an additional removal of heat and evaporated sweat. The vents are arranged so that they provide ventilation in areas with high skin temperature and/or high sweat production. Preferably, the vents are arranged so that the air can circulate "around" the body, for example an air stream over the shoulder or along the sides of the torso. In one embodiment, a vent may act as an entry vent, and another vent may act as an exit vent.

Properties of materials which are suitable for the six climate zones according to an embodiment of the present invention are described in more detail in connection with FIGS. 19 to 23.

FIGS. 1*a*, 1*b* and 2*a*, 2*b* illustrate that there are significant differences between the skin temperature and sweat production of the male and the female body. This leads to different requirements for garments, i.e. a different arrangement of the climate zones at the garment. This difference will become clear in FIGS. 3 to 6, and as described herein. In addition, the requirements and therefore the climate zones of a garment for the summer (FIGS. 3 and 4) and a garment for the winter (FIGS. 5 and 6) may be different in an embodiment of the present invention due to the different outdoor temperatures.

Figure 3:
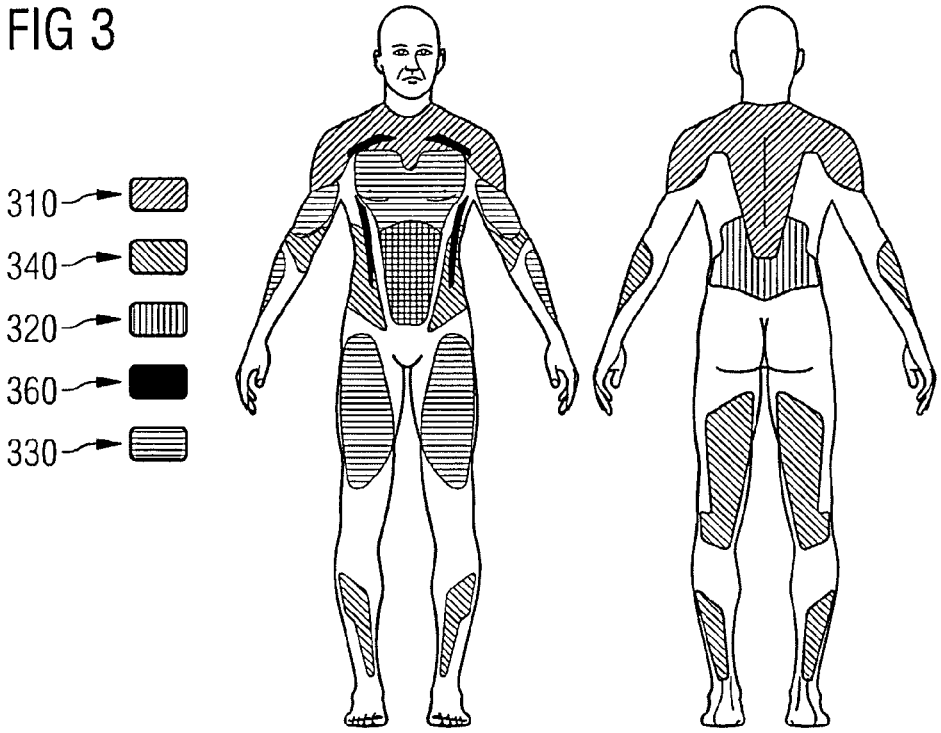
FIG. 3 is a front view and back view of a male body with climate zones for the manufacture of a summer garment according to an embodiment of the present invention.

FIG. 3 is a front view and a back view of a male body with climate zones for a summer (or warm temperature) garment according to an embodiment of the present invention. As can be seen, a first climate zone 310 with higher degree of air permeability is arranged in the shoulder area, in the upper portion of the upper arms and in the spine area. A second climate zone 320 with increased moisture wicking is arranged in the stomach area and in the area of the lumbar vertebrae. A third climate zone 330 with increased wind protection is arranged on the arms, in the breast area and on the front sides of the thighs. A fourth climate zone 340 with increased heat conductivity (i.e. reduced thermal resistance) is arranged in the elbow area, on the upper sides of the lower arms, laterally at the torso, on the front sides of the lower legs and on the back sides of the thighs and the lower legs. A sixth climate zone 360 with vents is arranged at the upper boundary of the breast area and laterally at the torso at the boundary of the breast area, since the air can best circulate around the body at these locations.

Figure 4:
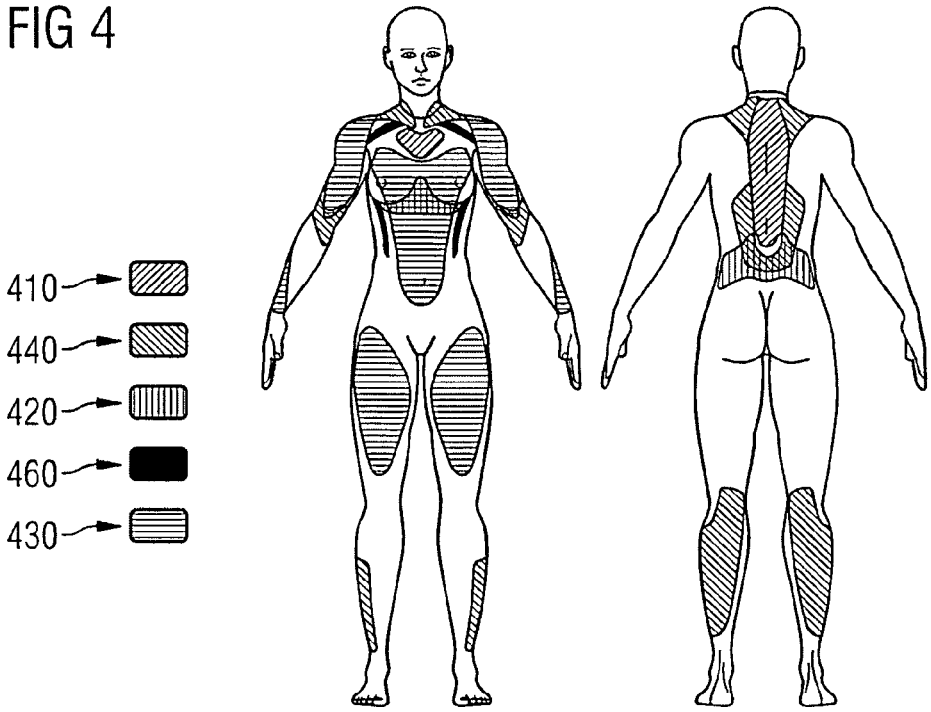
FIG. 4 is a front view and back view of a female body with climate zones for the manufacture of a summer garment according to an embodiment of the present invention.

FIG. 4 shows a front view and a back view of a female body with climate zones for a garment for the summer (or warm temperature) according to an embodiment of the present invention. A first climate zone 410 with a higher degree of air permeability is arranged between the neck area and the breast area and in the spine area. A second climate zone 420 with a higher degree of moisture wicking is arranged between the breast area and the stomach area and on the back in the area of the lumbar vertebrae. A third climate zone 430 with a higher degree of wind protection is arranged on the upper arms, the lower arms, in the breast area and in the stomach area, and on the front sides of the thighs. A fourth climate zone 440 with a higher degree of heat conduction (i.e. lower thermal resistance) is arranged in the shoulder area, in the elbow area (inside), in an area adjacent to the lower area of the spine and on the back sides of the lower lags. As sixth climate zone 460 with vents is arranged above the breast area and laterally at the torso at the boundary of the breast area so that air can circulate around the body.

In addition to the locations of the sixth climate zone on the front side of a garment, as shown for example in FIGS. 3 to 6, the sixth climate zone with vents can also be arranged on the back side of a garment, for example for backward-directed sports such as rowing.

Figure 5:
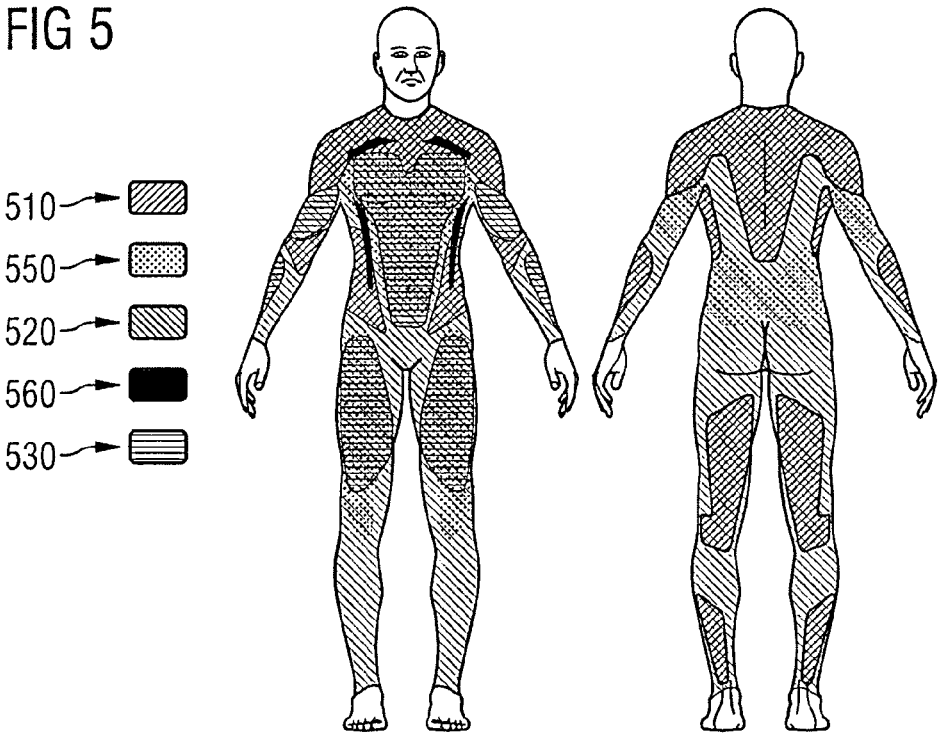
FIG. 5 is a front view and back view of a male body with climate zones for the manufacture of a winter garment according to an embodiment of the present invention.

FIG. 5 shows a front view and a back view of a male body with climate zones for a winter (or low temperature) garment according to an embodiment of the present invention. As shown in FIG. 5, a first climate zone 510 with a higher degree of air permeability of the garment is arranged in the shoulder area and in the upper portion of the upper arms, in the elbow area, in the spine area, laterally at the torso and on the back sides of the thighs and the lower legs. A second climate zone 520 with a higher degree of moisture wicking of the garment extends over the whole body which can be realized, for example, by a base material of the garment with a higher degree of moisture wicking. This may be necessary for low outdoor temperatures which lead to an overall lower skin temperature and therefore to a reduced evaporation of sweat. A third climate zone 530 with increased wind protection of the garment is located on the upper arms and the lower arms, in the breast area, in the stomach area and on the front sides of the thighs. A fourth climate zone with increased heat conductivity is not envisaged in the climate zones for low outdoor temperatures of FIG. 5 but can be added in other embodiments. A fifth climate zone 550 with increased heat insulation of the garment is arranged in the breast area, in the stomach area, on the back sides of the upper arms, in the area of the lumbar vertebrae and the kidneys, and on the front sides of the thighs. In these areas, sensitive parts of the body are protected, for example fat tissue with reduced blood circulation and organs. A sixth climate zone 560 with vents of the garment is located above the breast area and laterally at the torso at the boundary of the breast area. These vents are particularly important at low temperatures when a garment comprises several layers in order to guide air between the layers. The climate zones of the single layers have to be harmonized in order to enable transport of heat and/or sweat across several layers. Different functions are important for different layers.

Figure 6:
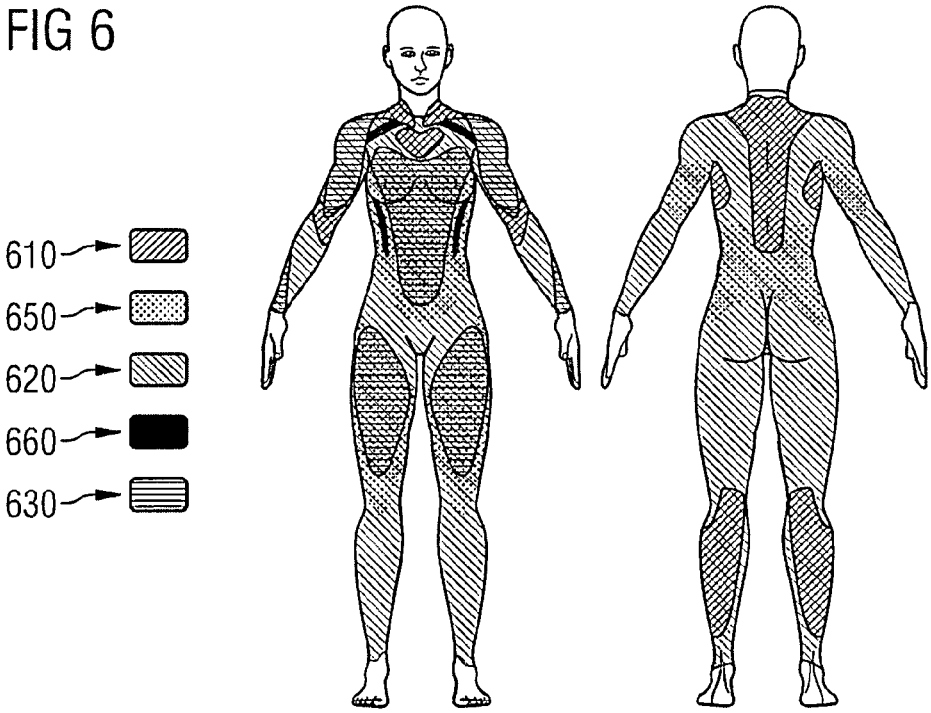
FIG. 6 is a front view and back view of a female body with climate zones for the manufacture of a winter garment according to an embodiment of the present invention.

FIG. 6 shows a front view and a back view of a female body with climate zones for a winter (or low temperature) garment according to an embodiment of the present invention. As shown in FIG. 6, a first climate zone 610 with a higher degree of air permeability of the garment is arranged in the shoulder area, in the elbow area, in the spine area, laterally at the torso and on the back sides of the thighs. A second climate zone 620 with increased moisture wicking of the garment extends as in FIG. 5 over the whole body. A third climate zone with increased wind protection 630 of the garment is arranged on the upper arms and the lower arms, in the breast area, in the stomach area and on the front sides of the thighs. The fourth climate zone with increased heat conductivity is not shown, similar to the climate zones for low temperatures of FIG. 5, but can be added in other embodiments. A fifth climate zone 650 with increased heat insulation of the garment is arranged in the breast area and the stomach area, on the back sides of the upper arms, in the area of the lumbar vertebrae and the kidneys and on the front sides of the thighs. A sixth climate zone 660 with vents at the garment is arranged above the breast area and laterally at the torso at the boundary of the breast area so that air can circulate around the body.

Both women and men may require a garment for the winter having several layers with different functions which are harmonized with each other. The single layers therein are adapted to gender-specific climate zones. One embodiment may comprise three layers: base layer—moisture wicking (plus heat insulations); medium layer—air permeability and insulation; outer layer—wind protection, air permeability (plus heat insulation). This sequence of layer provides transport of moisture from the inside to the outside and selective guidance of cold, fresh air between the layers. An embodiment of a garment with several layers is described in connection with FIGS. 15 and 16.

The principles for determining climate zones of garments derived in the foregoing which are based on empirical climate data can also be applied to other areas of the body. For example, embodiments will be described in the following FIGS. 7 to 9 with respect to the head and in FIGS. 10 to 12 with respect to the lower arm and the hand. A further application area is the foot which will be discussed with respect to FIGS. 24 to 28.

Figure 7:
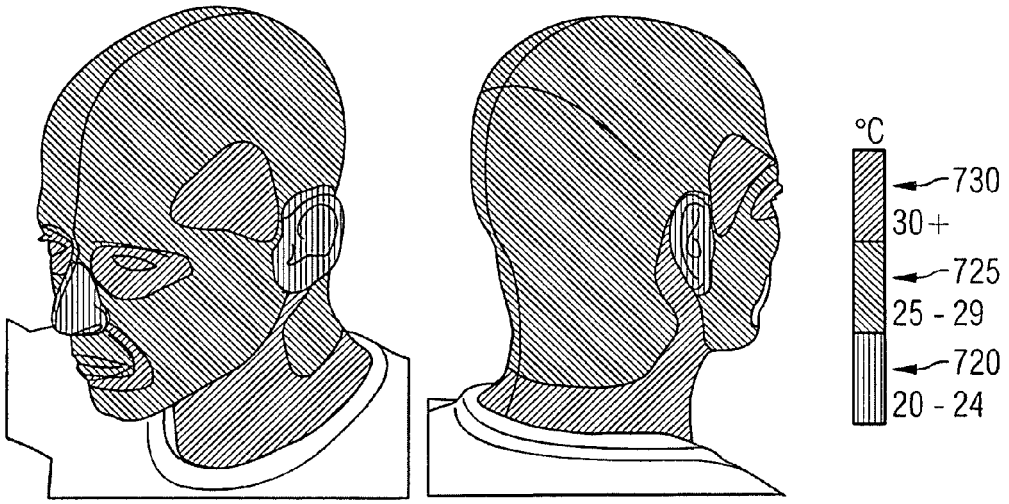
FIG. 7 is a perspective front view and back view of a head with skin temperatures during sports activities according to an embodiment of the present invention.

FIG. 7 shows a perspective front view and a back view of a head on which areas of skin temperatures during sports activities are shown according to an embodiment of the present invention. The views show the area of high skin temperature 730 with temperatures above about 30 degrees, the area of medium skin temperature 725 with temperatures from about 25 to about 29 degrees and the area of low skin temperature 720 with temperatures from about 20 to about 24 degrees. As illustrated, the area of high skin temperature 730 is located at the temples, in the eye area, at the boundary of the mouth, below and behind the ear and in the neck area. The area of medium skin temperature 725 extends from the cranium down to the neck and over the face. The area of low skin temperature 720 comprises the ears and the nose.

Figure 8:
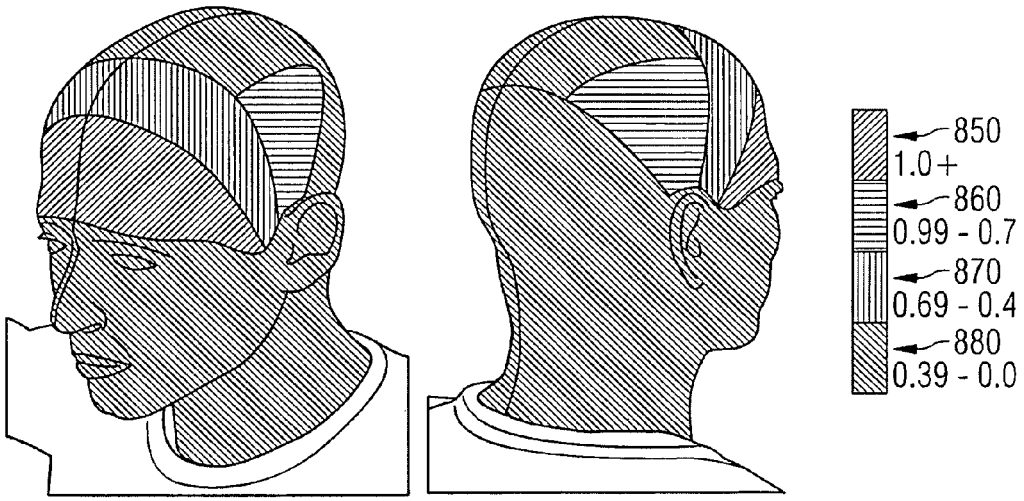
FIG. 8 is a perspective front view and back view of a head with degree of sweat production during sports activities according to an embodiment of the present invention.

FIG. 8 shows a perspective front view and a back view of a head which illustrates sweat production during sports activities according to one embodiment. The figure shows the area of strong sweat production 850 (>1.0), the area of increased sweat production 860 (0.99-0.7), the area of medium sweat production 870 (0.69-0.4) and the area of low sweat production 880 (0.39-0.0). As explained above, these values are relative values without units. As illustrated, the largest sweat production may be found in the forehead area and above the ears.

Figure 9:
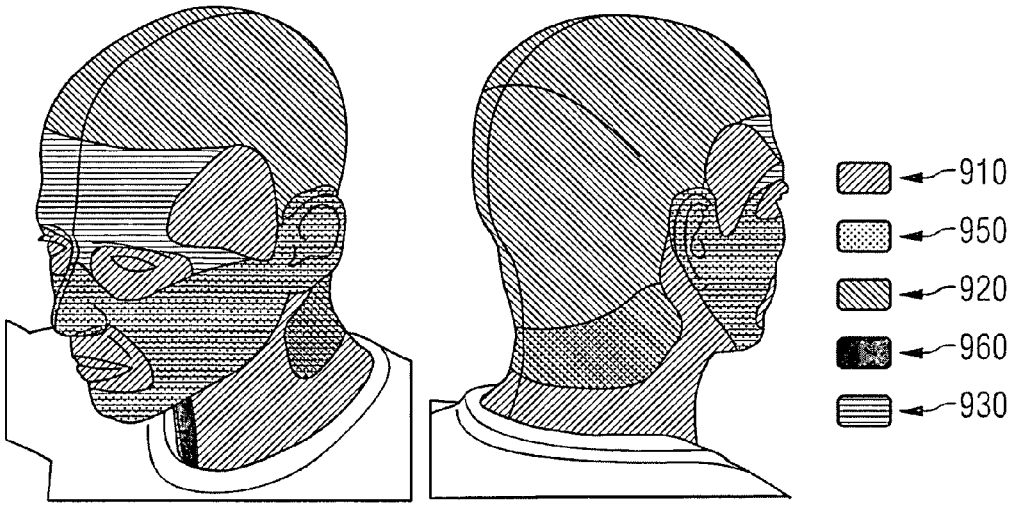
FIG. 9 is a perspective front view and back view of a head with climate zones according to an embodiment of the present invention.

FIG. 9 illustrates the climate zones for the head according to one embodiment which result from the skin temperatures and the sweat production shown in FIGS. 7 and 8. As illustrated, the first climate zone 910 with a higher degree of air permeability extends in the area of the temples, in the eye area, in the mouth area, behind the ear and in the neck area. A second climate zone 920 with increased moisture wicking extends from the cranium to the neck. A third climate zone 930 with increased wind protection extends over the face and the ears. A fifth climate zone 950 with increased heat insulation comprises the lower half of the face including the nose and the ears and an area between the cranium and the neck on the back side of the head. A sixth climate zone 960 comprises a vertical opening at the neck in the middle of the front side of the neck so that air can circulate around the neck having a high skin temperature.

Figure 10:
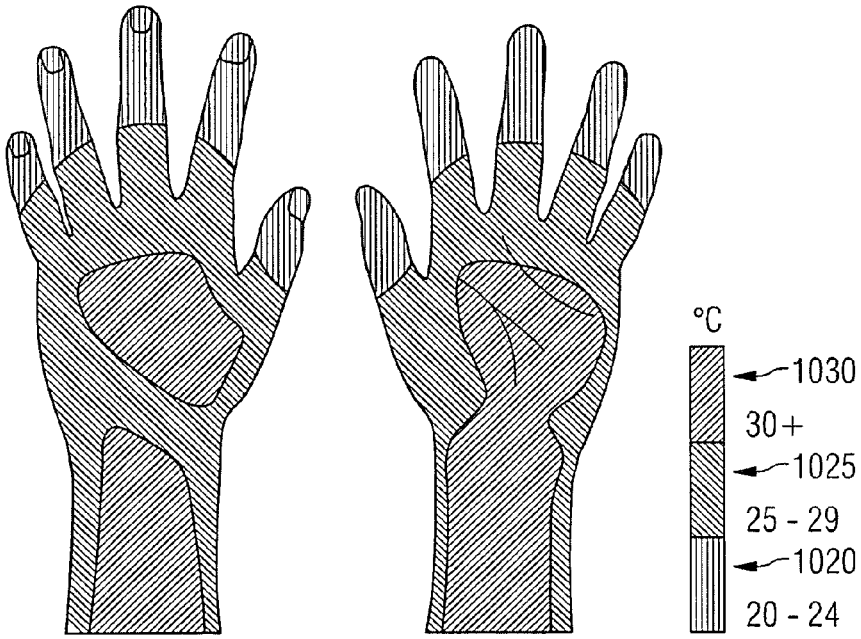
FIG. 10 is a perspective view of the back of a hand and the palm of a hand with skin temperatures during sports activities according to an embodiment of the present invention.

FIG. 10 shows views of a lower arm, a back of a hand and a palm of a hand, on which areas of skin temperatures during sports activities are illustrated according to one embodiment. The views show an area of high skin temperature 1030 with temperatures above about 30 degrees, an area of medium skin temperature 1025 with temperatures from about 25 to about 29 degrees and an area of low skin temperature 1020 with temperatures of about 20 to about 24 degrees. As illustrated, the areas of high skin temperature 1030 are located in the middle of the upper side and the lower side of the lower arm, on the back of the hand and on the palm of the hand. The area of medium skin temperature 1025 extends over the adjacent areas of the lower arm and the hand and the first member of each finger. The area of low skin temperature 1020 comprises the remaining second and third members of the fingers.

Figure 11:
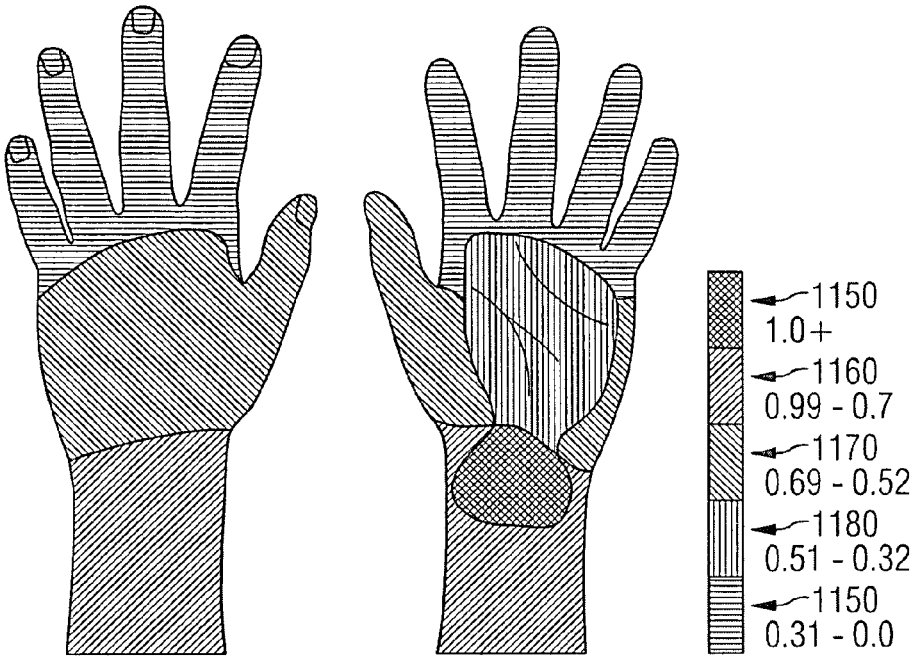
FIG. 11 is a perspective view of the back of a hand and the palm of a hand with degree of sweat production during sports activities according to an embodiment of the present invention.

FIG. 11 shows views of a lower arm, the back of a hand and the palm of a hand which illustrate sweat production during sports activities according to one embodiment. The figure shows an area of very high sweat production 1150 (>1.0), an area of high sweat production 1160 (0.99-0.7), the area of medium sweat production 1170 (0.69-0.52), an area of low sweat production 1180 (0.51-0.32) and an area of very low sweat production 1190 (0.31-0.00). As explained above, these values are relative values without units. As illustrated, the strongest sweat production may be found on the upper side and the lower side of the lower arm and on the back of the hand including the thumb. The fingers show the lowest sweat production.

Figure 12:
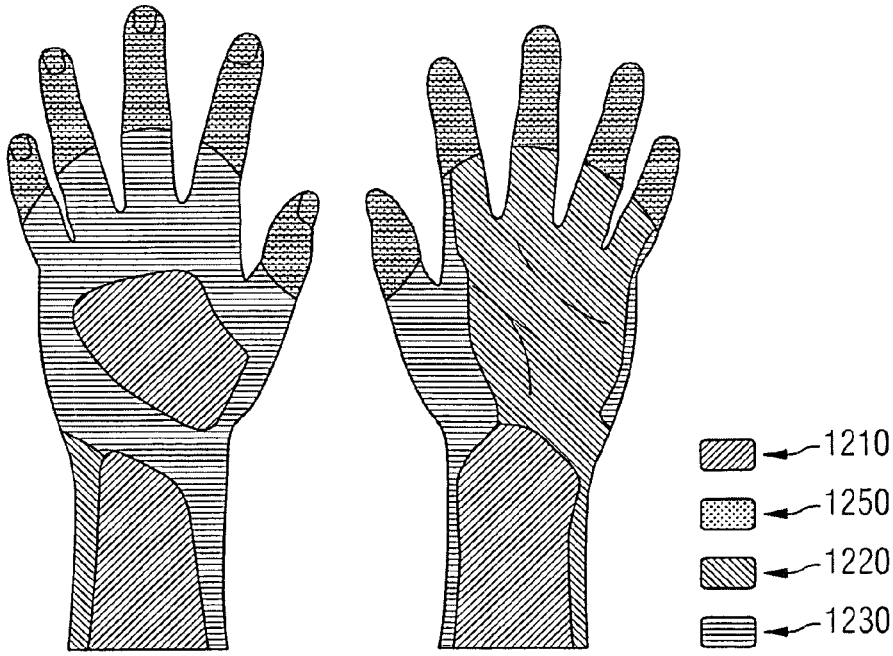
FIG. 12 is a perspective view of the back of a hand and the palm of a hand with climate zones according to an embodiment of the present invention.

FIG. 12 illustrates the climate zones for a hand according to one embodiment resulting from the skin temperatures and the sweat production shown in FIGS. 10 and 11. In one embodiment, a first climate zone 1210 with a higher degree of air permeability extends over the front side and the back side of the lower arm and the back of the hand. A second climate zone 1220 with increased moisture wicking extends over the palm of the hand and a narrow side of the lower arm. A third climate zone 1230 with increased wind protection extends over the adjacent narrow side of the lower arm, the back of the hand and the fingers. A fifth climate zone 1250 with increased heat insulation finally comprises the two front members of the fingers.

FIGS. 13 to 18 show garments which were designed according to the previously described climate zones and which therefore have an advantageous thermal regulation. In these figures, reference numerals for symmetric parts of a garment are only indicated once.

Figure 13:
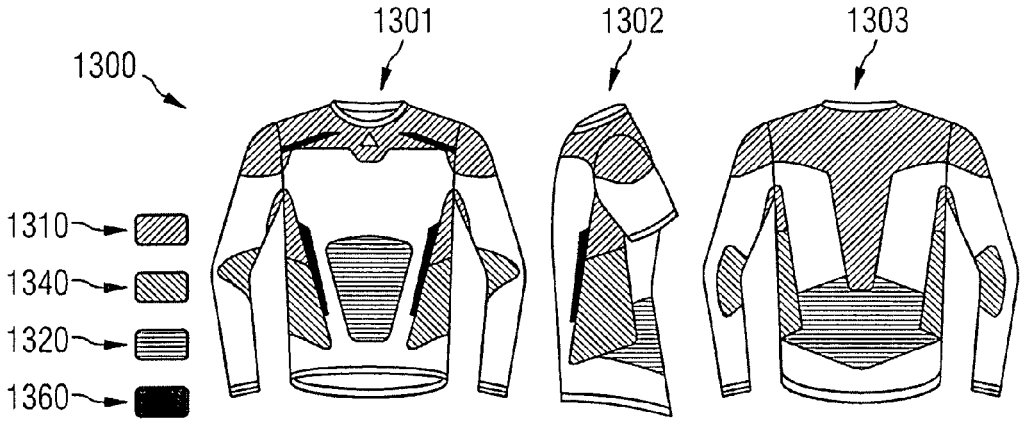
FIG. 13 is a front view, side view, and back view of a garment for men according to an embodiment of the present invention.

FIG. 13 illustrates a sports garment 1300 according to an embodiment of the present invention for a man in a front view 1301, a side view 1302 and a back view 1303, preferably for the summer (or warm temperatures). A first zone 1310 with higher degree of air permeability is arranged in the shoulder area and in the spine area, according to the first climate zone 310 in FIG. 3. In the embodiment of FIG. 13, the first zone 1310 also comprises a lateral area of the torso and on the inside of the upper arms which can also be omitted. Further, a second zone 1320 with increased moisture wicking is arranged on the front side 1300 in the stomach area and on the back side 1301 in the area of the lumbar vertebrae and the kidneys, according to the second climate zone 320 in FIG. 3. A fourth zone 1340 of the garment with reduced thermal resistance is located laterally at the torso and in the elbow area (inside) according to the climate zone 340 in FIG. 3. Finally, sports garment 1300 comprises a sixth zone 1360 with at least one vent which is located laterally at the torso and above the breast area, according to the sixth climate zone 360 in FIG. 3.

Figure 14:
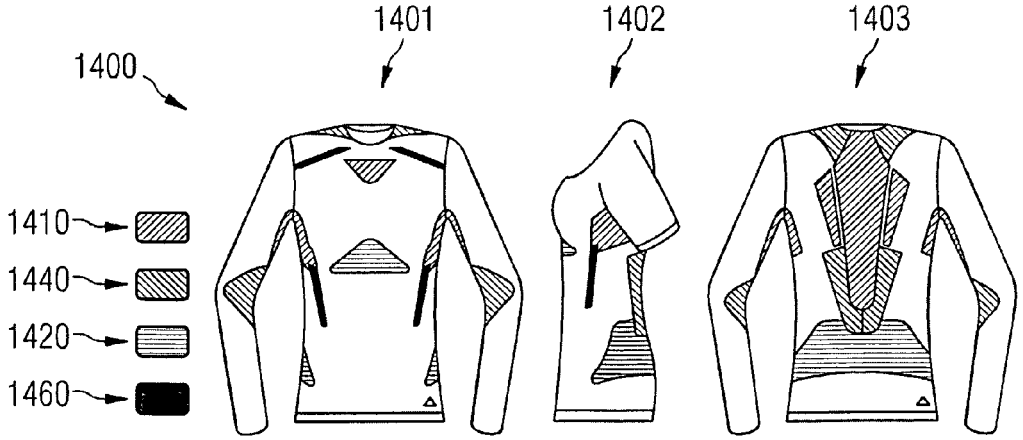
FIG. 14 is a front view, side view, and back view of a garment for women according to an embodiment of the present invention.

FIG. 14 shows a summer (or warm weather) sports garment 1400 according to an embodiment of the present invention for women in a front view 1401, a side view 1402 and a back view 1403. As illustrated, there is a first zone 1410 with a higher degree of air permeability which is arranged above the breast area and in the spine area, according to the first climate zone 410 in FIG. 4. In the embodiment of FIG. 14, the first zone 1410 also comprises an area laterally at the torso and on the inside of the upper arm which can also be omitted. Further, a second zone 1420 with increased moisture wicking is illustrated which is arranged in the front view 1401 below the breast area and in the side view 1402 and in the back view 1403 in the area of the lumbar vertebrae and the kidneys, according to the second climate zone 420 in FIG. 4. A fourth climate zone 1440 with reduced thermal resistance is arranged in the shoulder area, in the elbow area (inside) and in an area adjacent to the lower spine area, according to the fourth climate zone 440 in FIG. 4. Finally, the garment 1300 comprises a sixth zone 1360 with at least one vent which is located laterally at the torso and above the breast area, according to the sixth climate zone 360 in FIG. 3.

Both in FIG. 13 and FIG. 14 the air permeability in the first zone 1310, 1410 is higher than in the second zone 1320, 1420 and in the fourth zone 1340, 1440. Further, the moisture wicking capability in the second zone 1320, 1420 is higher than in the first zone 1310, 1410 and in the fourth zone 1340, 1440. Finally, the thermal resistance in the fourth zone 1340, 1440 is lower than in the first zone 1310, 1410 and in the second zone 1320, 1420.

Figure 15:
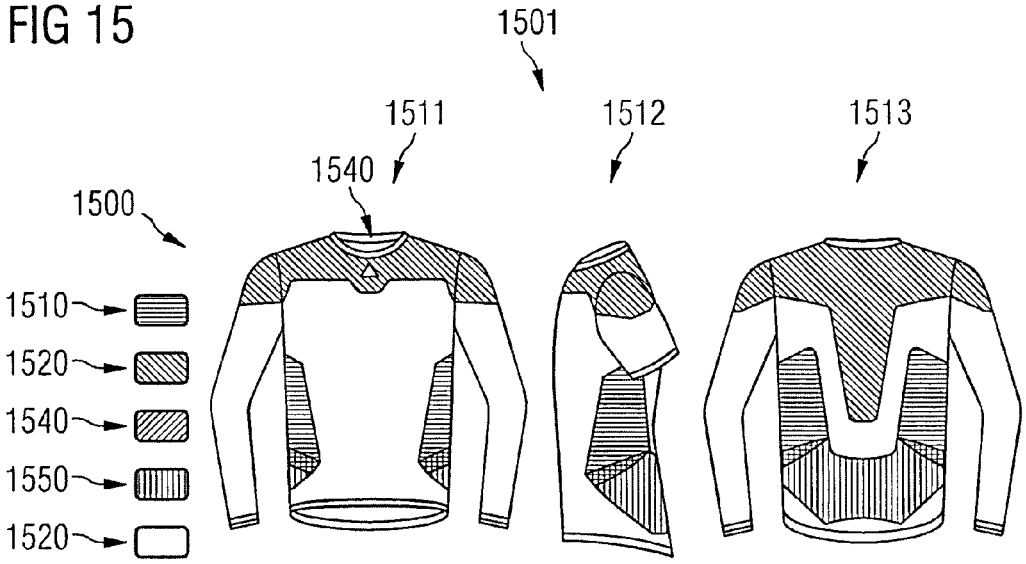
FIG. 15 is a front view, side view, and back view of a garment according to an embodiment of the present invention.

FIGS. 15, 16*a* and 16*b* illustrate a multi layer sports garment 1500 according to an embodiment of the present invention which is in particular suited for the winter (or low temperature), wherein FIG. 15 represents a first layer 1501, FIG. 16*a* represents a first embodiment 1601 for a second layer, and FIG. 16*b* represents a second embodiment 1602 for the second layer. In one embodiment, the layers 1501, 1601 and 1602 may respectively form a separate garment which can be worn separately or worn in combination with one or more other layers above or adjacent each other.

FIG. 15 illustrates a first layer 1501 of a sports garment 1500 according to an embodiment of the present invention in a front view 1511, a side view 1512, and a back view 1513. The first layer 1501 may form an inner layer of the sports garment 1500 in one embodiment. The first layer 1501 may include a first zone 1510 with a higher degree of air permeability which is essentially arranged laterally at the torso and on the back, in accordance with the climate zones in FIGS. 5 and 6. A second zone 1520 with increased moisture wicking extends over the whole sports garment 1500. A corresponding material may form the base material of the first layer 1501. In the areas of increased sweat production on the shoulders and in the spine area (see, e.g., first climate zone 510 in FIG. 5) a second zone 1520 with a higher degree of moisture wicking is arranged which transports the sweat to a second layer 1601, 1602 (see, e.g., FIGS. 16*a*, 16*b*) where a first area 1610 with a higher degree of air permeability for evaporating the sweat is arranged.

A fifth zone 1550 with increased heat insulation is arranged in the area of the lumbar vertebrae and on the back sides of the upper arms. Finally, a fourth zone with 1540 with reduced thermal resistance is arranged in the neck area and optionally (not illustrated) in the area of the wrists.

FIG. 16*a* illustrates a second layer 1601 of the sports garment 1500 according to an embodiment of the present invention in a front view 1611, a side view 1612, and a back view 1613, again in accordance with the climate zones in FIGS. 5 and 6. The second layer 1601 may form a middle layer or an outer layer of the sports garment 1500. FIG. 16*a* illustrates a first zone 1610 with a higher degree of air permeability which is arranged in the shoulder area, laterally at the body and in the spine area. A second zone 1620 with increased moisture wicking extends over the whole base material. Further, a fifth climate zone 1650 with increased heat insulation extends in the breast area and in the stomach area, and in the area of the lumbar vertebrae and the kidneys.

Finally, a third zone 1630 with increased wind protection is arranged in the breast area and in the stomach area, and in the area of the lumbar vertebra and the kidneys, wherein the third zone 1630 may be a subset of the fifth zone 1650.

FIG. 16*b* illustrates an alternative second layer 1602 of the sports garment 1500 according to an embodiment of the present invention in a front view 1621, a side view 1622, and a back view 1623. The second layer or outer layer 1602 differs from the second layer or outer layer 1601 from FIG. 16*a* in that it does not comprise a third area 1630 with a higher degree of wind protection.

FIG. 17 shows a sports garment 1700 according to one embodiment in a front view 1701 and a back view 1702, preferably for the winter (or low temperature use). As shown for example in FIG. 17, a first zone 1710 with a higher degree of air permeability may be disposed in the shoulder area, in particular above the breast, laterally at the torso and on the back, in particular in the spine area, according to the first climate zones 510, 610 shown in FIGS. 5 and 6. Further, sports garment 1700 may include a third zone 1730 with a higher degree of wind protection which is arranged in the breast area, in accordance with the third climate zones 530, 630 in FIGS. 5 and 6. The third zone 1730 is additionally arranged on the front side of the neck (see front view 1701). A fifth zone 1750 with a higher degree of head insulation is arranged in the area of the lumbar vertebrae and the kidneys, according to the fifth climate zones 550, 650 in FIGS. 5 and 6. As shown in FIG. 17, sports garment 1700 may further include a sixth zone 1760 with vents which are arranged above the breast area and laterally at the torso, in accordance with the sixth climate zones 560, 660 in FIGS. 5 and 6. Such vents may optionally be arranged also on the back side 1702. The vents may be equipped, for example, with a zipper so that the opening width of the vent may be varied to regulate the air stream. The vents are particularly important when several layers of a garment are worn above each other. Fresh air flows through the vents between the garment layers and removes wet and/or warm air.

In one embodiment, an advantageous thermal regulation for a garment may also result from a layer system (not illustrated) which comprises a base layer, a middle layer and an outer layer. The base layer may be disposed on the inside of the garment system adjacent to the body for providing regulation of heat and sweat and comprises a first zone with a higher degree of air permeability and a second zone with a higher degree of moisture wicking. A middle layer of the garment system provides regulation of the body temperature and comprises a first zone with a higher degree of air permeability, a fifth zone with increased heat insulation and/or a third zone with a higher degree of wind protection. An outer layer of the garment system protects against extreme environmental impacts and provides regulation of the micro climate in the garment system. It is important that within such a layer systems the thermo regulating zones of the single layers are harmonized with respect to each other. For example, a vent 1760 of the outer layer should be arranged above a first zone of the middle layer so that heat and sweat can be transported from the inside to the outside and air can penetrate from the outside to the inside.

In one embodiment the base layer may be formed by the first layer 1510 from FIG. 15, and the middle layer may be formed from the second layer 1610, 1620 from FIG. 16*a* or FIG. 16*b*. An embodiment of the outer layer may be formed by the garment 1700 in FIG. 17. Every layer can also be used separately without the other layers.

FIG. 18 illustrates a sports garment according to an embodiment of the present invention in a front view 1800, a back view 1801 and a lateral view 1802, preferably for the winter (or low temperature use). The sports garment includes an area 1830 which forms both a third climate zone with increased wind protection and a fifth climate with increased insulation. The area 1830 is arranged on the front sides of the thighs, in agreement with the third climate zones 530, 630 and the fifth climate zones 550, 650 in FIGS. 5 and 6.

In one embodiment, the garments illustrated in FIGS. 13-18 having first to sixth zones can be manufactured in a conventional way, for example by cutting and sewing. However, in another embodiment the seams may also be glued or melded. The patterns may be designed so that they are adjusted to motion sequences of particular sports activities. Apart from cutting and sewing a manufacture without seams (for example circular knitting) is conceivable.

FIG. 19 shows different illustrations of a material suitable for the first zone which has higher air permeability than the other zones according to one embodiment. This material comprises a yarn which is dry in an initial state. When the material absorbs moisture, the yarn elongates. When the material dries again, it returns to its initial state, and the yarn contracts. This increases the air permeability of a fabric made from this yarn in a wet state and reduces the air permeability in a dry state, as explained in the following. This provides drying of the skin beneath. In one embodiment, this material is VENTCOOL™ from Mitsubishi. Other suitable materials may be used.

View 1901 in FIG. 19 is a microscope image of a moisture-sensitive yarn or fiber in a dry state. In this state, the yarn is shorter and thicker than in a wet state. As can be recognized, the fibers of the yarn have a helical shape which makes the yarn thicker. In the wet state of view 1903 the yarn has elongated and therefore is thinner. The fibers in view 1903 have a plane, straight shape. As can be clearly recognized, a fabric made from this yarn has in dry state smaller interspaces (view 1902) than in a wet state (view 1904). A sports garment made from such a fabric will therefore have much better ventilation in a wet state than in a dry state which facilitates evaporation of the sweat from the skin and drying of a wet garment.

The higher degree of air permeability of such a fabric with a moisture-sensitive yarn can be demonstrated in experiments, as illustrated in FIG. 20 which is intended to be exemplary and not limiting. This figure shows measurements of the air permeability of different materials which are indicated in L/min (liter/minute). The measurements 2001, 2002 concern a fabric made from a moisture-sensitive yarn, wherein the measurement 2001 represents the air permeability in a dry state and the measurement 2002 represents the air permeability in a wet state. As shown for example in FIG. 20, the air permeability in a wet state (measurement 2002) is more than 50% higher than in a dry state (measurement 2001). In contrast, the air permeability of a fabric made from cotton in a dry state (measurement 2003) is even larger than in a wet state (measurement 2004). The same applies to a fabric made from polyester where the air permeability in a dry state (measurement 2005) is slightly larger than in a wet state (measurement 2006). These two materials therefore do not provide the required increase in ventilation when wet.

In further embodiments a higher degree of air permeability of a material or fabric for the first zone may be achieved, for example, by holes in a fabric which may have different sizes. The holes may be generated, for example, by perforation or by lasing using a laser. A further possibility for the manufacture of an air-permeable material is a fabric with large meshes, wherein the fabric may comprise different mesh sizes.

A preferred material for the second zone which comprises higher moisture wicking than the other zones is a material which transports moisture by capillary action. The capillary action may be achieved by a corresponding material structure, by properties of the yarn of the material and/or by a chemical treatment of a material (e.g. fleece) of the second zone. In this way, sweat can be absorbed from the skin and transported to the outside of the material where it can evaporate to the outside air.

As an alternative, a hydrophobic, moisture repellent material can be used for the second climate zone. In this way, cooling by evaporation of sweat can be improved by transporting moisture to locations where it can evaporate more easily.

In one embodiment, a material for the climate zone which comprises a higher degree of wind protection than the other climate zones has an air permeability in the range of 0-50 mm/s and, in one embodiment, particularly an air permeability of 0-10 mm/s. Corresponding air permeabilities can be achieved by a corresponding density of the fabric, for example a fleece, a laminated material (laminar gluing with a film layer, for example Windstopper™ of W. L. Gore Associates, Inc.), a coated material (liquid coating), material layers connected, for example, with glue points, or other suitable materials.

In one embodiment, a suitable material for the fourth zone which comprises a lower thermal resistance than the other climate zones can be achieved by metallic yarns which may be embedded in a thin and flat textile material. Such a textile material preferably comprises 1-10% of a metallic yarn, in particular a silver yarn. A corresponding textile material, for example a fabric, has to be woven such that the metallic yarn is located both on the side of the fabric directed to the skin and on the outside of the fabric, in order to provide heat conduction from the inside to the outside of the fabric. A further material suitable for the fourth zone is a textile material which is coated with heat-conducting material.

In one embodiment, a material for the fourth climate zone has a density less than about 100 g/m$^2$. In one embodiment, a thermal resistance of such a material is less than about 6×103 m$^2$K/W. A thermal resistance corresponds to a heat conductivity, wherein the heat conductivity increases when the thermal resistance decreases.

FIG. 21 shows measurements of the thermal resistance of three different materials which may be used in a sports garment according to an embodiment of the present invention. Measurement 2101 concerns a material which comprises about 95.5% polyester and about 4.5% of a conductive material, for example X-static or silver, at a density of 100 g/m$^2$. Measurement 2102 concerns a material made from 100% polyester at a density of 139 g/m$^2$. Measurement 2103 finally concerns a material which comprises 96% polyester and a 4% metallic content, for example X-static or silver, at a density of 128 g/m$^2$.

The thermal resistance of a material is not only influenced by its density and composition, but also by its structure respectively the volume and the thickness of the material. The thicker a material, the larger is the thermal resistance, since air accumulates in the interspaces. A particularly low thermal resistance therefore results from a combination of a conducting material and a very thin and/or flat constitution of the material.

In one embodiment, the fifth zone which has higher heat insulation than the other zones may comprise a light weight material having fibers with a raised 3-D structure. In this way, air can be trapped, which reduces heat exchange, and thereby provides improved heat insulation. Examples of such materials are brushed-up or roughened spandex, polyester, or fleece, or the like. Additionally or alternatively, an appropriate material may comprise on its inside, i.e. the side directed towards the body, a reflecting material which reduces heat radiation by the body.

The vents of the sixth zone which are preferably used in multilayer garments can be formed, for example, by openings or slits in the garment. The size of the openings or slits may be adaptable by using zippers. In one embodiment, a mesh may be arranged behind such an opening.

It is also conceivable to use materials which simultaneously fulfill the requirements of more than one zone. For example, in one embodiment a material may simultaneously provide a higher degree of wind protection (third zone) and increased heat insulation (fifth zone). Also conceivable are materials which combine the features of a moisture wicking material (second zone) with the features of the first, the third, the fourth and/or the fifth zone. A combination of a higher degree of moisture wicking (second zone) and a higher degree of heat insulation (fifth zone) results from roughening of an appropriate material.

A material which simultaneously fulfills the requirements of several climate zones can be used to realize an overlap of different climate zones. Alternatively, overlapping climate zones can be achieved by multi-layer garments, wherein a first layer fulfills the requirements of first climate zone and second layer fulfills the requirement of a second climate zone.

In one embodiment, the different climate zones should be compatible, as shown for example in connection with FIGS. 15, 16*a* and 16*b*. In such an embodiment, a second zone 1520 in a first layer with a higher degree of moisture wicking is arranged at the same location as a first zone 1510 in a second layer with a higher degree of air permeability is arranged.

In one embodiment, garments which can be turned inside out and which have different material properties on the outside and on the inside of the garment may be used. An example would be a higher degree of moisture wicking (second zone) on one side and a higher degree of head insulation (fifth zone) on the other side. Other combinations of a first side and a second side are roughened/not roughened (roughening improves both moisture wicking and heat insulation) or moisture wicking (hydrophobic)/non-moisture wicking (hygroscopic) or heat-reflecting/heat-absorbing. Such a garment could be turned inside out or vice versa according to the outdoor temperature.

Garments which are provided with specific zones corresponding to climate zones according to the preceding description lead to a significantly improved body climate for the wearer of the garment which can also be measured, as shown in FIGS. 22 and 23. These figures compare the skin temperature and the relative skin humidity of a wearer of a garment according to the invention to a conventional garment during different sports activities.

FIG. 22 illustrates the skin temperature of a wearer of a garment according to an embodiment of the present invention. As shown, the skin temperature of a wearer of a conventional garment (measurements 2201, 2203, 2205, 2207) varies strongly between the running phases 2201, 2205 and the inactive phases 2203, 2207. In contrast, the skin temperature of a wearer of a garment according to embodiments of the present invention (measurements 2202, 2204, 2206, 2208) is significantly below the skin temperatures of the conventional garment during the running phases 2202, 2206 and only shows a minor increase during the inactive phases 2204, 2208. In summary, the skin temperature of the wearer of a garment according to embodiments of the present invention remains significantly lower and shows much smaller variations than for the conventional garment. This improved garment thermal regulation significantly improves the comfort of the wearer.

Similar observations can be made with respect to the relative skin humidity of a wearer, as shown for example in FIG. 23. As shown, the relative skin humidity of a wearer of a conventional garment (measurements 2301, 2303, 2305, 2307) is relatively high and steadily increases during the running phases 2301, 2305 and during the inactive phases 2303, 2307. In contrast, the relative skin humidity of a wearer of a garment according to embodiments of the present invention (measurements 2302, 2304, 2306, 2308) is significantly lower, wherein the difference to the conventional garment amounts to about 25 percentage points during all activity phases.

The principles for the design of garments based on climate zones which are based on empirical climate data and which have been described in the foregoing can also be applied to the foot, as described in the following.

FIG. 24 shows a perspective view of a foot with an illustration of skin temperatures, ranging from areas of highest temperature 2450, areas of high temperature 2460, and areas of medium temperature 2470 to areas with low temperatures 2480. View 2401 shows the skin temperature before an activity. View 2402 shows the skin temperature during an activity, and view 2403 finally shows the skin temperature after an activity.

FIG. 25 shows areas of strong sweat production 2504 of a foot in a lateral view 2501, a bottom view 2502, and top view 2503.

FIG. 26 illustrates a sock according to an embodiment of the present invention. The sock comprises specific zones corresponding to the areas of highest temperature and high temperature in FIG. 24 and areas of strong sweat production in FIG. 25. A first zone 2610 with a higher degree of air permeability and a second zone 26 with a higher degree of moisture wicking can be recognized in lateral view 2601, bottom view 2602 and top view 2603. The first zone 2610 is arranged on the upper side of the sock in the toe area (see lateral view 2601 and top view 2603) and on the lower side of the sock in the toe area and in the area of the foot arch (see bottom view 2602). The second zone 2620 is arranged on the upper side of the sock in the metatarsal area (see lateral view 2601 and top view 2603).

These zones of the sock correspond to zones of a shoe which is illustrated in FIG. 27 in a lateral view, a bottom view 2702, and a top view 2703. The shoe may include a first zone 2710 with a higher degree of air permeability and a second zone 2720 with a higher degree of moisture wicking 2720 are arranged in correspondence with the first and the second zones of the sock from FIG. 26. The sock in FIG. 26 and the shoe in FIG. 27 form a combined system for improved thermal regulation, as shown for example in FIG. 28 in a lateral view 2801, a bottom view 2802 and a top view 2803. In some embodiments, the zones of the sock and the shoe may be harmonized to provide one or more of the advantages described herein.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A garment, comprising:

at least a first and a second zone, wherein:

the first zone of the garment is arranged in the spine area, wherein the first zone comprises a higher degree of air permeability than the second zone; and the second zone of the garment is arranged below the breast area and in the area of the lumbar vertebrae, wherein the second zone comprises a higher degree of moisture wicking than the first zone.

2. A garment, comprising:

at least a first zone and a second zone and a third zone, wherein:

the first zone of the garment comprises a higher degree of air permeability than the other zones;

the second zone of the garment comprises a higher degree of moisture wicking than the other zones; and the third zone of the garment comprises a higher degree of wind protection than the other zones.

3. A garment according to claim 2, wherein the first zone is arranged in the spine area and laterally at the torso.

4. A garment according to claim 2, wherein the first zone is arranged in the shoulder area and in the spine area.

5. A garment according to claim 2, wherein the second zone is below the breast area and in the area of the lumbar vertebrae.

6. A garment according to claim 2, wherein the third zone is arranged on the front sides of the arms and on the front side of the torso.

7. A garment according to claim 2, wherein the third zone is arranged on the front sides of the thighs.

8. A garment according to claim 2, further comprising:

a fourth zone of the garment, wherein the fourth zone comprises a lower degree of thermal resistance than the other zones.

9. A garment according to claim 8, wherein the fourth zone is arranged laterally at the torso and in the elbow area.

10. A garment according to claim 8, wherein the fourth zone is arranged on hack sides of the thighs, on the front sides of the lower legs and on the back sides of the lower legs.

11. A garment according to claim 8, wherein the fourth zone is arranged in the shoulder area and in the hack area.

12. A garment according to claim 8, wherein the fourth zone is arranged on the front sides of the lower legs and the back sides of the lower legs.

13. A garment according to claim 8, wherein the third zone is arranged on the front sides of the arms and on the front side of the torso.

14. A garment according to claim 8, wherein the third zone is arranged on the front sides of the thighs.

15. A garment comprising:

at least a first zone, a second zone and a fourth zone, wherein:

the first zone of the garment comprises a higher degree of air permeability than the other zones;

the second zone of the garment comprises a higher degree of moisture wicking than the other zones; and the fourth zone of the garment comprises a lower degree of thermal resistance than the other zones.

16. A garment according to claim 15, wherein the first zone is arranged in the spine area and laterally at the torso.

17. A garment according to claim 15, wherein the first zone is arranged in the shoulder area and in the spine area.

18. A garment according to claim 15, wherein the second zone is below the breast area and in the area of the lumbar vertebrae.

19. A garment according to claim 15, wherein the fourth zone is arranged laterally at the torso and in the elbow area.

20. A garment according to claim 15, wherein the fourth zone is arranged on back sides of the thighs, on the front sides of the lower legs and on the back sides of the lower legs.

21. A garment according to claim 15, wherein the first zone is arranged between the neck area and the breast area and in the spine area.

22. A garment according to claim 15, wherein the second zone is arranged between the breast area and the stomach area and in the area of the lumbar vertebra.

23. A garment according to claim 15, wherein the fourth zone is arranged in the shoulder area and in the back area.

24. A garment according to claim 15, wherein the fourth zone is arranged on the front sides of the lower legs and the back sides of the lower legs.

25. A garment, comprising:

a first zone, a second zone, and a fifth zone, wherein:

the first zone of the garment comprises a higher degree of air permeability than the other zones, the second zone of the garment comprises a higher degree of moisture wicking than the other zones; and the fifth zone of the garment comprises a higher degree of heat insulation than the other zones.

26. A garment according to claim 25, further comprising:

a third zone of the garment, wherein the third zone of the garment comprises a higher degree of wind protection than the other zones.

27. A garment according to claim 25, wherein the first zone is arranged in the shoulder area and in the spine area.

28. A garment according to claim 25, wherein the first zone is arranged laterally at the torso.

29. A garment according to claim 25, wherein the second zone is arranged in the shoulder area and in the spine area.

30. A garment according to claim 25, wherein the fifth zone is arranged in the area of the lumbar vertebra.

31. A garment according to claim 25, wherein the fifth zone is arranged laterally at the torso.

32. A garment according to claim 25, wherein the garment comprises a first layer and a second layer.

33. A garment according to claim 32, wherein the first zone is arranged in the second layer and the second zone is arranged in the first layer.

34. A garment according to claim 32, wherein the first zone is arranged laterally at the torso in the first layer, and wherein the first zone is arranged in the shoulder area and in the spine area and laterally at the torso in the second layer.

35. A garment according to claim 32, wherein the fifth zone is arranged in the area of the lumbar vertebra in the first layer, and wherein the fifth zone is arranged laterally at the torso and in the area of the lumbar vertebra in the second layer.

36. A garment according to claim 25, further comprising a sixth zone comprising at least one entry vent.

37. A garment according to claim 36, wherein the at least one entry vent is arranged between the shoulder area and the breast area.

38. A garment according to claim 36, further comprising at least one exit vent in a back area of the garment wherein said at least one exit vent is arranged so that air can enter through the at least one entry vent into the garment and can exit through the at least one exit vent.

39. A garment according to claim 25, wherein the first zone comprises a material whose structure comprises ventilation openings.

40. A garment according to claim 25, wherein the first zone comprises a material with ventilation openings generated by a manufacturing step selected from the group consisting of perforation or lasing.

41. A garment according to claim 25, wherein the first zone comprises a material which has in a wet state an air permeability which is at least 25% higher than in a dry state.

42. A garment according to claim 41, wherein the first zone comprises a fabric with a yarn whose length changes when exposed to moisture.

43. A garment according to claim 42, wherein the yarn is adapted for elongation and wherein the fabric is formed so that at least one ventilation opening in the fabric is enlarged when the yarn is elongated.

44. A garment according to claim 43, wherein the elongation of the yarn is reversible so that at least one ventilation opening in the fabric gets smaller when the yarn contracts.

45. A garment according to claim 25, wherein the second zone comprises a material which transports moisture by capillary action.

46. A garment according to claim 45, wherein the second zone comprises a yarn and the capillary action is effected by a structural property of the yarn.

47. A garment according to claim 45, wherein the capillary action is affected by a chemical treatment of a material of the second zone.

48. A garment according to claim 26, wherein the third zone comprises a material selected from the group consisting of: a high density material, a laminated material, a coated material including a material with a liquid coating, or a material having layers connected with glue points.

49. A garment according to claim 25, further comprising a fourth zone, wherein the fourth zone comprises a material having a thermal resistance less than about 6·103 m2K/W.

50. A garment according to claim 49, wherein the fourth zone comprises a material having a thin and flat fabric with metallic yarns.

51. A garment according to claim 49, wherein the fourth zone comprises a material with a fabric which is coated with a thermally conductive material.

52. A garment according to claim 25, wherein the fifth zone comprises a material with interspaces for trapping air.

53. A garment according to claim 52, wherein the interspaces for enclosing air of the fifth zone are generated during manufacture of the material.

54. A garment according to claim 36, wherein the at least one entry vent can be partially closed.

55. A garment, comprising:

a first zone and a second zone, wherein:

the first zone of the garment comprises a higher degree of air permeability than the second zone, and the second zone of the garment comprises a higher degree of moisture wicking than the first zone, wherein the first zone comprises a material which has in a wet state an air permeability which is at least 25% higher than in a dry state.

56. A garment, comprising:

a first zone and a fourth zone, wherein:

the first zone of the garment comprises a higher degree of air permeability than the fourth zone, and the fourth zone comprises a material having a thermal resistance less than about 6·103 m2K/W.

* * * * *

UNITED STATES PATENT AND TRADEMARK OFFICE

CERTIFICATE OF CORRECTION

PATENT NO. : 8,910,313 B2
APPLICATION NO. : 12/926051
DATED : December 16, 2014
INVENTOR(S) : Josh Gordon It is certified that error appears in the above-identified patent and that said Letters Patent is hereby corrected as shown below:

In the Claims

At column 19, line 47 (claim 10), replace "arranged on hack sides of the thighs" with --arranged on back sides of the thighs--.

At column 19, line 50 (claim 11), replace "in the hack area" with --in the back area--.

At column 21, line 8 (claim 40), replace "the group consisting of" with --the group consisting of:--.

Signed and Sealed this
Ninth Day of June, 2015

Michelle K. Lee

Michelle K. Lee
*Director of the United States Patent and Trademark Office*